US007899197B2

(12) United States Patent
Mayazaki

(10) Patent No.: US 7,899,197 B2
(45) Date of Patent: Mar. 1, 2011

(54) ELECTROSTATIC TRANSDUCER, DRIVING CIRCUIT OF CAPACITIVE LOAD, METHOD FOR SETTING CIRCUIT CONSTANT, ULTRASONIC SPEAKER, DISPLAY DEVICE AND DIRECTIONAL ACOUSTIC SYSTEM

(75) Inventor: Shinichi Mayazaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1147 days.

(21) Appl. No.: 11/558,307

(22) Filed: Nov. 9, 2006

(65) Prior Publication Data

US 2007/0121969 A1 May 31, 2007

(30) Foreign Application Priority Data

Nov. 15, 2005 (JP) ..... 2005-329846
Jul. 24, 2006 (JP) ..... 2006-200997
Sep. 12, 2006 (JP) ..... 2006-246779

(51) Int. Cl.
*H04R 3/00* (2006.01)
*H04R 25/00* (2006.01)
*H04R 5/02* (2006.01)

(52) U.S. Cl. ..... 381/116; 381/191; 381/111; 381/306

(58) Field of Classification Search ..... 381/116, 381/191, 306, 311; 327/311, 312, 313; 455/311
See application file for complete search history.

(56) References Cited

U.S. PATENT DOCUMENTS 2,262,406 A * 11/1941 Rath ..... 455/210
3,007,046 A * 10/1961 Schultz ..... 455/341
2005/0149338 A1* 7/2005 Fukui ..... 704/278

FOREIGN PATENT DOCUMENTS

| | | |
|---|---|---|
| JP | 61-289800 | 12/1986 |
| JP | 01-160199 | 6/1989 |
| JP | 06-209499 | 7/1994 |
| JP | 2001-086587 | 3/2001 |

* cited by examiner

*Primary Examiner*—Curtis Kuntz
*Assistant Examiner*—Sunita Joshi
(74) *Attorney, Agent, or Firm*—Workman Nydegger

(57) ABSTRACT

Provided is an electrostatic transducer which is driven by a boosted driving signal by boosting a modulated signal obtained by modulating a carrier wave with an acoustic signal in an audio frequency band, the transducer including: an output transformer T which connects the electrostatic transducer to a secondary side winding thereof in parallel and boosts the modulated signal; and a resistor R and a coupling capacitance C1 connected in series to a primary side winding of the output transformer T, wherein a circuit constant of a primary side circuit of the output transformer T including a serial circuit of the resistor R and the coupling capacitance C1 and a circuit constant of a secondary side circuit of the output transformer including a self-inductance L2 and a load capacitance CL of the secondary side winding of the output transformer T are set such that a resonance frequency f0 of a circuit formed by the self-inductance L2 of the secondary side winding of the output transformer T and the load capacitance CL(F) of the electrostatic transducer is matched or approximately matched to a carrier wave frequency fc of the electrostatic transducer.

11 Claims, 18 Drawing Sheets

PASS CHARACTERISTIC OF WHOLE CIRCUIT WHEN COUPLING CAPACITANCE $C_1$ DOES NOT EXIST

RELATIONSHIP BETWEEN SYMMETRY PROPERTY OF PASS CHARACTERISTICS OF HPF AND LPF AND COUPLING CAPACITANCE

PASS CHARACTERISTIC OF WHOLE CIRCUIT (C1=12.7μF)

RELATIONSHIP BETWEEN FLATNESSES OF PASS CHARACTERISTICS OF HPF AND LPF AND PRIMARY SIDE EXTERNAL RESISTOR ($C_1$=12.7$\mu$F)

RESONANCE CHARACTERISTICS AND PASS CHARACTERISTICS OF HPF AND LPF

FREQUENCY CHARACTERISTICS OF SECONDARY SIDE OUTPUT VOLTAGE (LOAD TERMINAL VOLTAGE) AND PRIMARY SIDE CURRENT
(R=1.72Ω, $C_1$=12.7μF, Vin=25Vac)

RELATIONSHIP BETWEEN TRANSFORMER COUPLING COEFFICIENT AND PASS BAND

ELECTROSTATIC TRANSDUCER, DRIVING CIRCUIT OF CAPACITIVE LOAD, METHOD FOR SETTING CIRCUIT CONSTANT, ULTRASONIC SPEAKER, DISPLAY DEVICE AND DIRECTIONAL ACOUSTIC SYSTEM

BACKGROUND

1. Technical Field

The present invention relates to an electrostatic transducer, and more particularly, to an electrostatic transducer for reproducing sound having sharp directivity by outputting a modulated wave obtained by modulating a carrier wave in an ultrasonic band with an acoustic signal in an audio frequency band, an ultrasonic speaker using the electrostatic transducer, a display device having the ultrasonic speaker, a directional acoustic system, and a driving circuit of a capacitive load.

2. Related Art

An ultrasonic speaker can reproduce sound having sharp directivity by outputting a modulated wave obtained by modulating a carrier wave in an ultrasonic band with an acoustic signal in audio frequency band. In a transducer (transmitter) of the ultrasonic speaker, a piezoelectric transducer is generally used. However, since the piezoelectric transducer uses a sharp resonance characteristic, a sound pressure is high, but a frequency band is narrow. Accordingly, in the ultrasonic speaker using the piezoelectric transducer, a reproducible frequency band is narrow and thus reproduction quality deteriorates compared with a loudspeaker.

Accordingly, there is provided an ultrasonic speaker (see an example of an electrostatic transducer according to the invention shown in FIGS. 1A to 1C) using an electrostatic transducer for vibrating a vibration membrane by applying an electrostatic force between a vibration membrane electrode and a fixed electrode to generate a sound pressure. The electrostatic transducer is characterized in that a flat output sound pressure characteristic can be obtained over a wide frequency range. Therefore, the ultrasonic speaker using the electrostatic transducer can provide superior reproduction quality compared with the piezoelectric transducer.

In the electrostatic transducer, a high voltage of at least several hundreds V need be applied between the vibration membrane electrode and the fixed electrode, in order to generate a high sound pressure. Accordingly, in order to drive the electrostatic transducer, a voltage is generally boosted by an output transformer (for example, see JP-A-6-209499).

Since the electrostatic transducer has the same configuration as that of a capacitor, a capacitance component dominates in an electrical characteristic of the transducer. Accordingly, when the electrostatic transducer is driven by the output transformer, a resonance circuit system is formed by an inductance component of the transformer and a capacitance component of the transducer. By the influence of the resonance, a frequency characteristic of a terminal voltage (output voltage) of the transducer significantly varies and thus a flat output characteristic cannot be obtained. Accordingly, the reproduction quality of the ultrasonic speaker deteriorates.

When a resonance frequency band can be significantly shifted from a driving frequency band, the frequency characteristic is made nearly flat. In the ultrasonic speaker, a driving frequency band is in an ultrasonic band. Accordingly, in order to significantly shift the resonance frequency band of a circuit from the driving frequency band to a high frequency band, a coil inductance of the output transformer must be very small and this is not realistic.

The coil inductance value of the output transformer and the capacitance value of the electrostatic transducer are restricted within realistic ranges due to a structural limit. Accordingly, by a combination the inductance value and the capacitance value, the resonance frequency band of the circuit is relatively in the vicinity of the driving frequency band. That is, when the output transformer is interposed, the output frequency characteristic of the ultrasonic speaker significantly varies.

By connecting a register to a primary side or a secondary side of the output transformer, the frequency characteristic of the output voltage can be made flat, but loss occurs by the resistor. This is not preferable because low power loss which is a feature of the electrostatic transducer is eliminated.

As the ultrasonic transducer in the related art, there is disclosed a configuration which is capable of matching impedance and ensuring the flat output frequency characteristic by implementing a butterworth filter using a circuit constant (an inductance component and a capacitance component) of a piezoelectric element which is a load (see JP-A-2001-86587). However, since the configuration of the ultrasonic transducer in the related art is premised on the driving of the piezoelectric element, a problem may occur when the configuration applies to the driving of the electrostatic transducer.

In order to obtain the flat pass band characteristic by the configuration of a T-type or π-type LC filter disclosed in JP-A-2001-86587, a relatively large resistance component is required. Since the piezoelectric element has the relatively large resistance component as an electrical characteristic of the load, the flat pass band characteristic is realized by using the (relatively large) resistance component of the piezoelectric element, which is the load, as a portion of the filter, in JP-A-2001-86587.

Meanwhile, the electrostatic transducer basically has the same configuration as that of a film capacitor. Accordingly, the capacitance component dominates in the electrical characteristic of the transducer and a resistance component is very small (compared with the piezoelectric transducer). Accordingly, when the circuit configuration disclosed in JP-A-2001-86587 applies to the electrostatic transducer, an external resistor having a relatively high resistance value must be added in order to obtain the flat pass band characteristic and thus unnecessary power loss occurs by the resistor. However, when the resistor is not added, the LC filter has a steep response characteristic (resonance curve) and thus the flat pass band characteristic cannot be obtained.

SUMMARY

An advantage of some aspects of the invention is to provide an electrostatic transducer, a method for setting a circuit constant, an ultrasonic speaker, a display device having the ultrasonic speaker, and a directional acoustic system, which are capable of reducing a driving power of the electrostatic transducer and ensuring a flat output voltage frequency characteristic in a driving frequency band of the electrostatic transducer. Another advantage of some aspects of the invention is to provide a driving circuit of a capacitive load which can be driven with low loss while ensuring a flat output voltage frequency characteristic in a driving frequency band.

According to an aspect of the invention, there is provided an electrostatic transducer which is driven by a boosted driving signal by boosting a modulated signal obtained by modulating a carrier wave with an acoustic signal in an audio frequency band, the transducer comprising: an output transformer T which connects the electrostatic transducer to a secondary side winding thereof in parallel and boosts the modulated signal; and a resistor R and a coupling capacitance C1 connected in series to a primary side winding of the output transformer T, wherein a circuit constant of a primary side circuit of the output transformer T including a serial circuit of the resistor R and the coupling capacitance C1 and a circuit constant of a secondary side circuit of the output transformer including a self-inductance L2 and a load capacitance CL of the secondary side winding of the output transformer T are set such that a resonance frequency f0 of a circuit formed by the self-inductance L2 of the secondary side winding of the output transformer T and the load capacitance CL(F) of the electrostatic transducer is matched or approximately matched to a carrier wave frequency fc of the electrostatic transducer.

By this configuration, the electrostatic transducer (load capacitance CL) is connected in parallel to the secondary side of the output transformer T as the driven load, and the resistor R and the coupling capacitance C1 are connected in series to the primary side of the output transformer T. The circuit constants are set such that the resonance frequency f0 of the circuit formed by the self-inductance L2 of the secondary side winding of the output transformer T and the load capacitance CL is matched or approximately matched to a carrier wave frequency (driving frequency) fc of the electrostatic transducer.

Accordingly, the secondary side of the transformer T becomes a parallel resonance (antiresonance) state upon rated driving and current flowing into the primary side of the transformer T can be reduced while ensuring a predetermined output voltage (load terminal voltage). Therefore, the driving power of the electrostatic transducer can be reduced and thus the electrostatic transducer can be driven with low loss.

In the electrostatic transducer according to the aspect of the invention, the self-inductance L2 of the secondary side winding of the output transformer T may be set to $L2=1/(4\pi 2fc2CL)$ when the load capacitance of the electrostatic transducer is CL(F) and a rated carrier wave frequency of the electrostatic transducer is fc(Hz).

By this configuration, when the value of the self-inductance L2 of the secondary side winding of the output transformer T is set, the resonance frequency f0 of the circuit formed by the self-inductance L2 and the load capacitance CL is matched or approximately matched to a carrier wave frequency (driving frequency) fc of the electrostatic transducer.

Accordingly, by setting the value of the self-inductance L2 of the secondary side winding of the output transformer T, the secondary side of the transformer T can become the parallel resonance (antiresonance) state upon rated driving (the carrier wave frequency). Therefore, upon the rated driving, the current flowing into the primary side of the transformer T can be reduced while ensuring a predetermined output voltage (load terminal voltage). Thus, the driving power of the electrostatic transducer can be reduced and thus the electrostatic transducer can be driven with low loss.

In the electrostatic transducer according to the aspect of the invention, the electrostatic transducer may have terminals for applying the driving signal and the circuit constants may be set such that a frequency characteristic of a voltage between the terminals becomes a frequency characteristic of a band pass filter in which a driving frequency of the electrostatic transducer is included in a pass band.

By this configuration, when the value of the primary side coupling capacitance C1 and the resistor R are properly set in conformity to the electric characteristic (circuit constant) of the output transformer and the load capacitance CL(F) of the electrostatic transducer, the driving frequency of the electrostatic transducer is included in the pass band of the whole circuit.

Accordingly, it is possible to stably drive the electrostatic transducer in a wideband. More particularly, when the driving circuit of the electrostatic transducer according to the aspect of the invention is used in the ultrasonic speaker, it is possible to improve reproduction quality due to a flat output characteristic.

In the electrostatic transducer according to the aspect of the invention, in an equivalent circuit of the primary side circuit of the output transformer T and the secondary side circuit of the output transformer T including a driven load, when a −3 dB attenuation frequency at a lower frequency band side in a frequency characteristic of a first resonance circuit formed by the coupling capacitance C1, a leakage inductance LL of the output transformer T and a mutual inductance M1 is f1L, a −3 dB attenuation frequency at a high frequency band side in a frequency characteristic of a second resonance circuit formed by the coupling capacitance C1, the leakage inductance LL of the output transformer T and the load capacitance CL is f2H, and a resonance frequency of a resonance circuit formed by the mutual inductance M1, the leakage inductance LL and the load capacitance CL is f0, the circuit constants may be set such that $(f1L \cdot f2H)/f0^2=1$ is satisfied.

By this configuration, when the −3 dB attenuation frequency (cutoff frequency) at a lower frequency band side in a frequency characteristic of the first resonance circuit (HPF) formed by the coupling capacitance C1, the leakage inductance LL of the output transformer T and the mutual inductance M1 is f1L, the −3 dB attenuation frequency (cutoff frequency) at a high frequency band side in the frequency characteristic of the second resonance circuit (LPF) formed by the coupling capacitance C1, the leakage inductance LL of the output transformer T and the load capacitance CL is f2H, and the resonance frequency of the resonance circuit formed by the mutual inductance M1, the leakage inductance LL and the load capacitance CL is f0, each of the circuit constants are set such that $(f1L \cdot f2H)/f0^2=1$ is satisfied.

Accordingly, since the pass band characteristic of the first resonance circuit (HPF) and the pass band characteristic of the second resonance circuit (LPF) are substantially symmetrical and a resonance system having the high pass filter (HPF) and a resonance system having the low pass filter (LPF) are combined by the transformer, it is possible to realize a band pass filter characteristic which is symmetrical based on the parallel resonance frequency (antiresonance) f0 in the whole circuit.

In the electrostatic transducer according to the aspect of the invention, the circuit constants may be set such that a combination circuit for combining a first resonance circuit formed by the resistor R, the coupling capacitance C1, the leakage inductance LL and the mutual inductance M1 with a second resonance circuit formed by the resistor R, the coupling capacitance C1, the leakage inductance LL and the load capacitance CL by the output transformer T becomes a critical coupling state.

By this configuration, the first resonance circuit (HPF) formed at the primary side of the transformer and the second resonance circuit (LPF) formed at the secondary side of the transformer become the critical coupling state.

Accordingly, it is possible to flatten the pass band characteristic of the whole circuit. That is, since the resonance system having the high pass filter (HPF) characteristic and the resonance system having the low pass filter (LPF) characteristic are combined in the critical state, the both resonance systems have a smooth pass characteristic in which a sharp peak does not exist and thus the band pass filter characteristic in which a sharp peak does not exist in the whole circuit can be realized. Therefore, it is possible to stably drive the electrostatic transducer in a wideband. More particularly, when the driving circuit of the electrostatic transducer according to the aspect of the invention is used in the ultrasonic speaker, it is possible to improve reproduction quality due to the flat output characteristic.

In the electrostatic transducer according to the aspect of the invention, when a quality factor of the first resonance circuit is Q1, a quality factor of the second resonance circuit is Q2, and a coupling coefficient k of the output transformer T is k=(L1−LL)/L1, the circuit constants may be set such that k·Q1 or k·Q2 becomes a predetermined value.

By this configuration, when the quality factor of the first resonance circuit having the high pass filter (HPF) characteristic is Q1, the quality factor of the second resonance circuit having the low pass filter (LPF) characteristic is Q2, and the coupling coefficient k of the output transformer T is k=(L1−LL)/L1, the circuit constants are set such that k·Q1 or k·Q2 becomes the predetermined value.

Accordingly, it is possible to adjust the pass band characteristic of the whole circuit. That is, since the resonance system having the high pass filter (HPF) characteristic and the resonance system having the low pass filter (LPF) characteristic are combined while sharpness of each of the responses (in the vicinity of the resonance frequency) is separately adjusted, it is possible to voluntarily adjust the pass band characteristic (balance between the low frequency band and the high frequency band) of the whole circuit. Therefore, it is possible to drive the electrostatic transducer in a wideband while adjusting the output. More particularly, when the driving circuit of the electrostatic transducer according to the aspect of the invention is used in the ultrasonic speaker, it is possible to improve reproduction quality due to the balance adjustment of the reproduction band.

In the electrostatic transducer according to the aspect of the invention, the circuit constants may be set such that at least one of values √2(k·Q1) and √2(k·Q2) is equal or approximately equal to 1.

By this configuration, when the quality factor of the first resonance circuit having the high pass filter (HPF) characteristic is Q1, the quality factor of the second resonance circuit having the low pass filter (LPF) characteristic is Q2, and the coupling coefficient k of the output transformer T is k=(L1−LL)/L1, at least one of values √2(k·Q1) and √2(k·Q2) is equal or approximately equal to 1. That is, when an additional resistor is not connected to the secondary side of the output transformer T, the quality factors of the HPF and the LPF may not be equal according to the winding specification of the transformer. In this case, since both √2(k·Q1)=1 and √2(k·Q2)=1 cannot be satisfied, the value of the primary side additional resistor R is set such that any one of the values becomes 1. In addition, when a proper additional resistor is connected to the secondary side of the transformer, the both quality factors can be equal and thus a complete BPF characteristic can be realized.

Accordingly, even when the additional resistor is not connected to the secondary side winding of the output transformer T, it is possible to make the pass band characteristic of the whole circuit nearly flat, while causing a problem in practice. That is, since the resonance system having the high pass filter (HPF) characteristic and the resonance system having the low pass filter (LPF) characteristic are combined in the critical state, the both resonance systems have a smooth pass band characteristic in which a sharp peak does not exist and thus the band pass filter characteristic in which a sharp peak does not exist in the whole circuit can be realized.

Therefore, it is possible to stably drive the electrostatic transducer in a wideband. More particularly, when the driving circuit of the electrostatic transducer according to the aspect of the invention is used in the ultrasonic speaker, it is possible to improve reproduction quality due to the flat output characteristic.

In the electrostatic transducer according to the aspect of the invention, the circuit constants may be set such that both the condition of $(f1L \cdot f2H)/f0^2=1$ and the condition that the combination circuit for combining the first resonance circuit formed by the resistor R, the coupling capacitance C1, the leakage inductance LL and the mutual inductance M1 with the second resonance circuit formed by the resistor R, the coupling capacitance C1, the leakage inductance LL and the load capacitance CL by the output transformer T becomes the critical coupling state are satisfied.

By this configuration, the pass band characteristic of the HPF and the pass band characteristic of the LPF are substantially symmetrical by setting the circuit constants such that $(f1L \cdot f2H)/f0^2=1$ is satisfied. When the resonance circuit (HPF) formed at the primary side of the transformer and the resonance circuit (LPF) formed at the secondary side of the transformer are combined in the critical coupling state, it is possible to flatten the pass band characteristic.

Accordingly, it is possible to flatten the pass band characteristic of the whole circuit. That is, since the resonance system having the high pass filter (HPF) characteristic and the resonance system having the low pass filter (LPF) characteristic are combined in the critical state, the responses of the both resonance systems are matched and flat and thus the flat band pass filter (BPF) characteristic can be realized in the whole circuit. Therefore, it is possible to stably drive the electrostatic transducer in a wideband. More particularly, when the driving circuit of the electrostatic transducer according to the aspect of the invention is used in the ultrasonic speaker, it is possible to improve reproduction quality due to the flat output characteristic.

In the electrostatic transducer according to the aspect of the invention, the circuit constants may be set such that both the condition of $(f1L \cdot f2H)/f0^2=1$ and the condition that, when a quality factor of a first resonance circuit formed by the resistor R, the coupling capacitance C1, the leakage inductance LL and the mutual inductance M1 is Q1, a quality factor of a second resonance circuit formed by the resistor R, the coupling capacitance C1, the leakage inductance LL and the load capacitance CL is Q2, and a coupling coefficient k of the output transformer T is k=(L1−LL)/L1, k·Q1 or k·Q2 becomes a predetermined value are satisfied.

By this configuration, the pass band characteristic of the HPF and the pass band characteristic of the LPF are substantially symmetrical by setting the circuit constants such that $(f1L \cdot f2H)/f0^2=1$ is satisfied. In addition, the pass band characteristic is adjusted by setting the circuit constants such that k·Q1 or k·Q2 becomes the predetermined value.

Accordingly, it is possible to adjust (flatten) the pass band characteristic of the whole circuit. That is, since the resonance system having the high pass filter (HPF) characteristic and the resonance system having the low pass filter (LPF) characteristic are combined by the transformer while adjusting the sharpness of the response (in the vicinity of the resonance frequency), it is possible to realize a symmetry property based on the parallel resonance frequency (antiresonance) f0 in the whole circuit and the (flat) band pass filter characteristic with the balance between the high frequency band and the low frequency band. Therefore, it is possible to stably drive the electrostatic transducer in a wideband. More particularly, when the electrostatic transducer according to the aspect of the invention is used in the ultrasonic speaker, it is possible to improve reproduction quality due to the balance adjustment of the reproduction band.

In the electrostatic transducer according to the aspect of the invention, the circuit constants may be set such that both the condition of $(f1L \cdot f2H)/f0^2=1$ and the condition that, when a quality factor of a first resonance circuit formed by the resistor R, the coupling capacitance C1, the leakage inductance LL and the mutual inductance M1 is Q1, a quality factor of a second resonance circuit formed by the resistor R, the coupling capacitance C1, the leakage inductance LL and the load capacitance CL is Q2, and a coupling coefficient k of the output transformer T is $k=(L1-LL)/L1$, at least one of values $\sqrt{2}(k \cdot Q1)$ and $\sqrt{2}(k \cdot Q2)$ is equal or approximately equal to 1 are satisfied.

By this configuration, the pass band characteristic of the HPF and the pass band characteristic of the LPF are substantially symmetrical by setting the circuit constants such that $(f1L \cdot f2H)/f0^2=1$ is satisfied. In addition, at least one of values $\sqrt{2}(k \cdot Q1)$ and $\sqrt{2}(k \cdot Q2)$ is equal or approximately equal to 1. When an additional resistor is not connected to the secondary side of the output transformer T, the quality factors of the HPF and the LPF may not be equal according to the winding specification of the transformer. In this case, since both $\sqrt{2}(k \cdot Q1)=1$ and $\sqrt{2}(k \cdot Q2)=1$ cannot be satisfied, the value of the resistor R is set such that any one of the values becomes 1. Accordingly, it is possible to flatten the pass band characteristic.

Accordingly, it is possible to flatten the pass band characteristic of the whole circuit. That is, since the response of the resonance system having the high pass filter (HPF) characteristic and the response of the resonance system having the low pass filter (LPF) characteristic are substantially symmetrical and the resonance system having the high pass filter (HPF) characteristic and the resonance system having the low pass filter (LPF) are combined by the transformer in a state where a peak does not exists in the response (in the vicinity of the resonance frequency), it is possible to realize a symmetry property based on the parallel resonance frequency (antiresonance) f0 in the whole circuit and the (flat) band pass filter (BPF) characteristic. Therefore, it is possible to stably drive the electrostatic transducer in a wideband. More particularly, when the electrostatic transducer according to the aspect of the invention is used in the ultrasonic speaker, it is possible to improve reproduction quality due to the flat output characteristic.

In the electrostatic transducer according to the aspect of the invention, the circuit constants may be set such that an audio frequency band is not included in a pass band of a band pass filter formed by the first resonance circuit and the second resonance circuit.

By this configuration, for example, when the value of the coupling coefficient (leakage inductance LL) of the transformer T is adjusted, it is possible to adjust the frequency width of the pass band. The audio frequency band is not included in the pass band.

Accordingly, in the ultrasonic speaker (electrostatic transducer) having superdirectivity, in order to reduce noise upon reproduction, it is possible to set the output frequency characteristic of the driving circuit such that the audio frequency band is excluded from the pass band. Therefore, it is possible to suppress audible sound from being directly output from the ultrasonic speaker (sound leakage). That is, it is possible to prevent directivity of the reproduction sound from deteriorating due to sound leakage.

In the electrostatic transducer according to the aspect of the invention, the electrostatic transducer may comprise a first side fixed electrode in which a plurality of holes are formed; a second side fixed electrode in which a plurality of holes are formed, the first side fixed electrode and the second side fixed electrode forming a pair; and a vibration membrane which is interposed between the pair of fixed electrodes and has a conductive layer to which a direct current bias voltage is applied, and the secondary side winding of the output transformer T has a center tap, one terminal of the secondary side winding of the output transformer T is connected to the first side fixed electrode of the electrostatic transducer and the other terminal thereof is connected to the second side fixed electrode, and the direct current bias voltage is applied from the center tap of the secondary side winding of the output transformer T to the conductive layer of the vibration membrane.

By this configuration, for example, in a push-pull type electrostatic transducer shown in FIGS. 1A to 1C, one terminal of the secondary side winding of the output transformer T is connected to the front side fixed electrode, the other terminal is connected to the rear side fixed electrode, and the direct current bias voltage is applied from the center tap of the secondary side winding of the output transformer T to the conductive layer of the vibration membrane.

Therefore, it is possible to stably drive the push-pull type electrostatic transducer in a wideband. More particularly, when the electrostatic transducer is used in the ultrasonic speaker, it is possible to improve reproduction quality due to the flat output characteristic.

The electrostatic transducer according to the aspect of the invention may comprise an audio frequency signal source which generates a signal wave in an audio frequency band; a carrier wave signal source which generates and outputs a carrier wave in an ultrasonic frequency band; a modulator which modulates the carrier wave with the signal wave in the audio frequency band; and a power amplifier which amplifies the signal modulated by the modulator and applies the amplified signal to the primary side winding of the transformer T through the resistor R and the coupling capacitance C1.

By this configuration, the carrier wave in the ultrasonic frequency band is modulated with the signal wave in the audio frequency band, the modulated signal is amplified by the power amplifier, and the amplified signal is applied to the primary side winding of the output transformer T through the resistor R and the coupling capacitance C1.

Accordingly, when the push-pull type electrostatic transducer is used in the ultrasonic speaker, it is possible to stable drive the ultrasonic speaker in a wideband and to improve reproduction quality.

According to the aspect of the invention, there is provided a driving circuit of a capacitive load for driving the capacitive load by a driving signal boosted by an output transformer T, wherein the capacitive load is connected in parallel to a secondary side winding of the output transformer T as a driven load and a resistor R and a coupling capacitance C1 are connected in series to a primary side winding of the output transformer T, and wherein circuit constants of a primary side circuit of the output transformer T including a serial circuit of the resistor R and the coupling capacitance C1 and a secondary side circuit of the output transformer including a self-inductance L2 and a load capacitance CL of the secondary side winding of the output transformer T are set such that a resonance frequency f0 of a circuit formed by the self-inductance L2 of the secondary side winding of the output transformer T and the load capacitance CL of the capacitive load is matched or approximately matched to a rated driving frequency fc of the capacitive load.

By this configuration, the capacitive load, for example, the electrostatic ultrasonic transducer or the piezoelectric ultrasonic transducer is connected in parallel to the secondary side of the output transformer T as the driven load and the resistor R and the coupling capacitance C1 are connected in series to the secondary side winding of the output transformer T. The circuit constants are set such that the resonance frequency f0 of the circuit formed by the self-inductance L2 of the secondary side winding of the output transformer T and the load capacitance CL is matched or approximately matched to the carrier wave frequency (driving frequency) fc of the capacitive load.

Accordingly, the secondary side of the transformer T becomes a parallel resonance (antiresonance) state upon rated driving and current flowing into the primary side of the transformer T can be reduced while ensuring a predetermined output voltage (load terminal voltage). Therefore, the power consumption in the power amplifier for driving the capacitive load can be reduced and thus the capacitive load can be driven with low loss in the whole system.

In the driving circuit of the capacitive load according to the aspect of the invention, when the capacitance of the driven load is CL(F) and the rated driving frequency of the capacitive load is fc(Hz), the self-inductance L2 of the secondary side winding of the output transformer T may be set to L2=1/(4π2fc2CL).

By this configuration, when the value of the self-inductance L2 of the secondary side winding of the output transformer T is set, the resonance frequency f0 of the circuit formed by the self-inductance L2 and the load capacitance CL is matched or approximately matched to the carrier wave frequency (driving frequency) fc of the capacitive load (the electrostatic ultrasonic transducer or the piezoelectric ultrasonic transducer).

Accordingly, by setting the value of the self-inductance L2 of the secondary side winding of the output transformer T, the secondary side of the transformer T can become the parallel resonance (antiresonance) state upon rated driving (the carrier wave frequency). Therefore, upon the rated driving, the current flowing into the primary side of the transformer T can be reduced while ensuring a predetermined output voltage (load terminal voltage). Thus, the power consumption in the power amplifier can be reduced and thus the capacitive load can be driven with low loss in the whole system.

In the driving circuit of the capacitive load according to the aspect of the invention, the capacitive load may have terminals for applying the driving signal and the circuit constants may be set such that a frequency characteristic of a voltage between the terminals becomes a frequency characteristic of a band pass filter in which a driving frequency of the capacitive load is included in a pass band.

By this configuration, when the value of the primary side coupling capacitance C1 and the resistor R are properly set in conformity to the electric characteristic (circuit constant) of the output transformer and the load capacitance CL of the capacitive load (the electrostatic ultrasonic transducer or the piezoelectric ultrasonic transducer), the driving frequency of the capacitive load is included in the pass band characteristic of the whole circuit.

Accordingly, it is possible to stably drive the capacitive load in a wideband. More particularly, when the driving circuit of the capacitive load according to the aspect of the invention is used in the ultrasonic speaker, it is possible to improve reproduction quality due to flat output characteristic.

According to another aspect of the invention, there is provided a method for setting circuit constants in a driving circuit of a capacitive load for driving the capacitive load by a driving signal boosted by an output transformer T, in which the capacitive load is connected in parallel to a secondary side winding of the output transformer T and a resistor R and a coupling capacitance C1 are connected in series to a primary side winding of the output transformer T, the method comprising: setting circuit constants of a primary side circuit of the output transformer T including a serial circuit of the resistor R and the coupling capacitance C1 and a secondary side circuit of the output transformer including a self-inductance L2 and a load capacitance CL of the secondary side winding of the output transformer T such that a resonance frequency f0 of a circuit formed by the self-inductance L2 of the secondary side winding of the output transformer T and the load capacitance CL of the capacitive load is matched or approximately matched to a rated driving frequency fc of the capacitive load.

By this sequence, when the capacitive load (load capacitance CL) is connected in parallel to the secondary side of the output transformer T as the driven load, and the resistor R and the coupling capacitance C1 are connected in series to the primary side of the output transformer T, the circuit constants are set such that the resonance frequency f0 of the circuit formed by the self-inductance L2 of the secondary side winding of the output transformer T and the load capacitance CL is matched or approximately matched to a carrier wave frequency (driving frequency) fc of the capacitive load.

Accordingly, the secondary side of the transformer T becomes a parallel resonance (antiresonance) state upon rated driving and current flowing into the primary side of the transformer T can be reduced while ensuring a predetermined output voltage (load terminal voltage).

The method for setting the circuit constants according to the aspect of the invention may comprise setting the self-inductance L2 of the secondary side winding of the output transformer T to L2=1/(4π2fc2CL), when the capacitance of the capacitive load which is a driven load is CL(F) and the rated driving frequency of the capacitive load is fc(Hz).

By this sequence, when the value of the self-inductance L2 of the secondary side winding of the output transformer T is set, the resonance frequency f0 of the circuit formed by the self-inductance L2 and the load capacitance CL is matched or approximately matched to a carrier wave frequency (driving frequency) fc of the capacitive load.

Accordingly, by setting the value of the self-inductance L2 of the secondary side winding of the output transformer T, the secondary side of the transformer T can become the parallel resonance (antiresonance) state upon rated driving due to the carrier wave frequency. Therefore, upon the rated driving, the current flowing into the primary side of the transformer T can be reduced while ensuring a predetermined output voltage (load terminal voltage). Thus, the load imposed to the power amplifier can be reduced and thus the capacitive load can be driven with low loss in the whole system.

In the method for setting the circuit constants according to the aspect of the invention, the capacitive load may have terminals for applying the driving signal, and the method may comprise setting the circuit constants such that a frequency characteristic of a voltage between the terminals becomes a frequency characteristic of a band pass filter in which a driving frequency of the capacitive load is included in a pass band.

By this sequence, when the value of the primary side coupling capacitance C1 and the resistor R are properly set in conformity to the electric characteristic (circuit constant) of the output transformer and the load capacitance CL of the capacitive load, the driving frequency of the capacitive load is included in the pass band characteristic of the whole circuit.

Accordingly, it is possible to stably drive the capacitive load in a wideband. More particularly, when the driving circuit of the electrostatic transducer according to the aspect of the invention is used in the ultrasonic speaker, it is possible to improve reproduction quality due to the flat output characteristic.

The method for setting the circuit constants according to the aspect of the invention may comprise setting the circuit constants such that $(f1L \cdot f2H)/f0^2=1$ is satisfied, in an equivalent circuit of the primary side circuit of the output transformer T and the secondary side circuit of the output transformer T including a driven load, when a −3 dB attenuation frequency at a lower frequency band side in a frequency characteristic of a first resonance circuit formed by the coupling capacitance C1, a leakage inductance LL of the output transformer T and a mutual inductance M1 is f1L, a −3 dB attenuation frequency at a high frequency band side in a frequency characteristic of a second resonance circuit formed by the coupling capacitance C1, the leakage inductance LL of the output transformer T and the load capacitance CL is f2H, and a resonance frequency of a resonance circuit formed by the mutual inductance M1, the leakage inductance LL and the load capacitance CL is f0.

By this sequence, when the −3 dB attenuation frequency at the lower frequency band side in the frequency characteristic of the first resonance circuit formed by the coupling capacitance C1, the leakage inductance LL of the output transformer T and the mutual inductance M1 is f1L, the −3 dB attenuation frequency at the high frequency band side in the frequency characteristic of the second resonance circuit formed by the coupling capacitance C1, the leakage inductance LL of the output transformer T and the load capacitance CL is f2H, and the resonance frequency of the resonance circuit formed by the mutual inductance M1, the leakage inductance LL and the load capacitance CL is f0, the circuit constants is set such that $(f1L \cdot f2H)/f0^2=1$ is satisfied.

Accordingly, since the pass band characteristic of the first resonance circuit (HPF) and the pass band characteristic of the second resonance circuit (LPF) are substantially symmetrical and a resonance system having the high pass filter (HPF) and a resonance system having the low pass filter (LPF) are combined by the transformer, it is possible to realize a band pass filter characteristic which is symmetrical based on the parallel resonance frequency (antiresonance) f0 in the whole circuit.

The method for setting the circuit constants according to the aspect of the invention may comprise setting the circuit constants such that a combination circuit for combining a first resonance circuit formed by the resistor R, the coupling capacitance C1, a leakage inductance LL and a mutual inductance M1 with a second resonance circuit formed by the resistor R, the coupling capacitance C1, the leakage inductance LL and the load capacitance CL by the output transformer T becomes a critical coupling state.

By this sequence, the first resonance circuit (HPF) formed at the primary side of the transformer and the second resonance circuit (LPF) formed at the secondary side of the transformer become the critical coupling state.

Accordingly, it is possible to flatten the pass band characteristic of the whole circuit. That is, since the resonance system having the high pass filter (HPF) characteristic and the resonance system having the low pass filter (LPF) characteristic are combined in the threshold state, the both resonance systems have a smooth pass band characteristic in which a sharp peak does not exist and thus the band pass filter characteristic in which a sharp peak does not exist in the whole circuit can be realized. Therefore, it is possible to stably drive the electrostatic transducer in a wideband. More particularly, when the driving circuit of the electrostatic transducer according to the aspect of the invention is used in the ultrasonic speaker, it is possible to improve reproduction quality due to the flat output characteristic.

The method for setting the circuit constants according to the aspect of the invention may comprise setting the circuit constants such that $k \cdot Q1$ or $k \cdot Q2$ becomes a predetermined value when a quality factor of the first resonance circuit is Q1, a quality factor of the second resonance circuit is Q2, and a coupling coefficient k of the output transformer T is $k=(L1-LL)/L1$.

By this sequence, when the quality factor of the first resonance circuit having the high pass filter (HPF) characteristic is Q1, the quality factor of the second resonance circuit having the low pass filter (LPF) characteristic is Q2, and the coupling coefficient k of the output transformer T is $k=(L1-LL)/L1$, the circuit constants are set such that $k \cdot Q1$ or $k \cdot Q2$ becomes the predetermined value.

Accordingly, it is possible to adjust the pass band characteristic of the whole circuit. That is, since the resonance system having the high pass filter (HPF) characteristic and the resonance system having the low pass filter (LPF) characteristic are combined while sharpness of each of the responses (in the vicinity of the resonance frequency) is separately adjusted, it is possible to voluntarily adjust the pass band characteristic (balance between the low frequency band and the high frequency band) of the whole circuit. Therefore, it is possible to drive the electrostatic transducer in a wideband while adjusting the output. More particularly, when the driving circuit of the electrostatic transducer according to the aspect of the invention is used in the ultrasonic speaker, it is possible to improve reproduction quality due to the balance adjustment of the reproduction band.

The method for setting the circuit constants according to the aspect of the invention may comprise setting the circuit constants such that at least one of values $\sqrt{2}(k \cdot Q1)$ and $\sqrt{2}(k \cdot Q2)$ is equal or approximately equal to 1.

By this sequence, when the quality factor of the first resonance circuit having the high pass filter (HPF) characteristic is Q1, the quality factor of the second resonance circuit having the low pass filter (LPF) characteristic is Q2, and the coupling coefficient k of the output transformer T is $k=(L1-LL)/L1$, at least one of values $\sqrt{2}(k \cdot Q1)$ and $\sqrt{2}(k \cdot Q2)$ is equal or approximately equal to 1. That is, when the external resistor is not separately connected to the secondary side of the output transformer T, the quality factors of the HPF and the LPF may not be equal according to the winding specification of the transformer. In this case, since both $\sqrt{2}(k \cdot Q1)=1$ and $\sqrt{2}(k \cdot Q2)=1$ cannot be satisfied, the value of the resistor R is set such that any one of the values becomes 1. In addition, when a proper external resistor is connected to the secondary side of the transformer, the both quality factors can be equal and thus a complete BPF characteristic can be realized.

Accordingly, even when the external resistor is not connected to the secondary side winding of the output transformer T, it is possible to flatten the pass band characteristic of the whole circuit, while causing a problem in practice. That is, since the resonance system having the high pass filter (HPF) characteristic and the resonance system having the low pass filter (LPF) characteristic are combined in the threshold state, the both resonance systems have a smooth pass band characteristic in which a sharp peak does not exist and thus the band pass filter (BPF) characteristic in which a sharp peak does not exist in the whole circuit can be realized.

Therefore, it is possible to stably drive the capacitive load in a wideband. More particularly, when the driving circuit of the electrostatic transducer according to the aspect of the invention is used in the ultrasonic speaker, it is possible to improve reproduction quality due to the flat output characteristic.

The method for setting the circuit constants according to the aspect of the invention may comprise setting the circuit constants such that both the condition of $(f1L \cdot f2H)/f0^2=1$ and the condition that the combination circuit for combining the first resonance circuit formed by the resistor R, the coupling capacitance C1, the leakage inductance LL and the mutual inductance M1 with the second resonance circuit formed by the resistor R, the coupling capacitance C1, the leakage inductance LL and the load capacitance CL by the output transformer T becomes the critical coupling state are satisfied.

By this sequence, the pass band characteristic of the HPF and the pass band characteristic of the LPF are substantially symmetrical by setting the circuit constants such that $(f1L \cdot f2H)/f0^2=1$ is satisfied. When the resonance circuit (HPF) formed at the primary side of the transformer and the resonance circuit (LPF) formed at the secondary side of the transformer are combined in the critical coupling state, it is possible to flatten the pass band characteristic.

Accordingly, it is possible to flatten the pass band characteristic of the whole circuit. That is, since the resonance system having the high pass filter (HPF) characteristic and the resonance system having the low pass filter (LPF) characteristic are combined in the threshold state, the responses of the both resonance systems are matched and flat and thus the flat band pass filter (BPF) characteristic can be realized in the whole circuit. Therefore, it is possible to stably drive the capacitive load in a wideband. More particularly, when the driving circuit of the electrostatic transducer according to the aspect of the invention is used in the ultrasonic speaker, it is possible to improve reproduction quality due to the flat output characteristic.

The method for setting the circuit constants according to the aspect of the invention may comprise setting the circuit constants such that both the condition of $(f1L \cdot f2H)/f0^2=1$ and the condition that, when a quality factor of a first resonance circuit formed by the resistor R, the coupling capacitance C1, the leakage inductance LL and the mutual inductance M1 is Q1, a quality factor of a second resonance circuit formed by the resistor R, the coupling capacitance C1, the leakage inductance LL and the load capacitance CL is Q2, and a coupling coefficient k of the output transformer T is $k=(L1-LL)/L1$, $k \cdot Q1$ or $k \cdot Q2$ becomes a predetermined value are satisfied.

By this sequence, the pass band characteristic of the HPF and the pass band characteristic of the LPF are substantially symmetrical by setting the circuit constants such that $(f1L \cdot f2H)/f0^2=1$ is satisfied. In addition, the pass band characteristic is adjusted by setting the circuit constants such that $k \cdot Q1$ or $k \cdot Q2$ becomes the predetermined value.

Accordingly, it is possible to adjust (flatten) the pass band characteristic of the whole circuit. That is, since the resonance system having the high pass filter (HPF) characteristic and the resonance system having the low pass filter (LPF) characteristic are combined by the transformer while adjusting the sharpness of the response (in the vicinity of the resonance frequency), it is possible to realize a symmetry property based on the parallel resonance frequency (antiresonance) f0 in the whole circuit and the (flat) band pass filter characteristic with the balance between the high frequency band and the low frequency band. Therefore, it is possible to stably drive the capacitive load in a wideband. More particularly, when the electrostatic transducer according to the aspect of the invention is used in the ultrasonic speaker, it is possible to improve reproduction quality due to the balance adjustment of the reproduction band.

The method for setting the circuit constants according to the aspect of the invention may comprise setting the circuit constants such that both the condition of $(f1L \cdot f2H)/f0^2=1$ and the condition that, when a quality factor of a first resonance circuit formed by the resistor R, the coupling capacitance C1, the leakage inductance LL and the mutual inductance M1 is Q1, a quality factor of a second resonance circuit formed by the resistor R, the coupling capacitance C1, the leakage inductance LL and the load capacitance CL is Q2, and a coupling coefficient k of the output transformer T is $k=(L1-LL)/L1$, at least one of values $\sqrt{2}(k \cdot Q1)$ and $\sqrt{2}(k \cdot Q2)$ is equal or approximately equal to 1 are satisfied.

By this sequence, the pass band characteristic of the HPF and the pass band characteristic of the LPF are substantially symmetrical by setting the circuit constants such that $(f1L \cdot f2H)/f0^2=1$ is satisfied. In addition, at least one of values $\sqrt{2}(k \cdot Q1)$ and $\sqrt{2}(k \cdot Q2)$ is equal or approximately equal to 1. When the external resistor is not separately connected to the secondary side of the output transformer T, the quality factors of the HPF and the LPF may not be equal according to the winding specification of the transformer. In this case, since both $\sqrt{2}(k \cdot Q1)=1$ and $\sqrt{2}(k \cdot Q2)=1$ cannot be satisfied, the value of the resistor R is set such that any one of the values becomes 1. Accordingly, it is possible to flatten the pass band characteristic.

Accordingly, it is possible to flatten the pass band characteristic of the whole circuit. That is, since the response of the resonance system having the high pass filter (HPF) characteristic and the response of the resonance system having the low pass filter (LPF) characteristic are substantially symmetrical and the resonance system having the high pass filter (HPF) characteristic and the resonance system having the low pass filter (LPF) are combined by the transformer in a state where a peak does not exists in the response (in the vicinity of the resonance frequency), it is possible to realize a symmetry property based on the parallel resonance frequency (antiresonance) f0 in the whole circuit and the (flat) band pass filter (BPF) characteristic. Therefore, it is possible to stably drive the capacitive load in a wideband. More particularly, when the electrostatic transducer according to the aspect of the invention is used in the ultrasonic speaker, it is possible to improve reproduction quality due to the flat output characteristic.

According to another aspect of the invention, there is provided an electrostatic transducer which is driven by a boosted driving signal by boosting a modulated signal obtained by modulating a carrier wave with an acoustic signal in an audio frequency band, the transducer comprising an ultrasonic transducer which includes an output transformer T which connects the electrostatic transducer to a secondary side winding thereof in parallel and boosts the modulated signal and a resistor R and a coupling capacitance C1 connected in series to a primary side winding of the output transformer T, and in which circuit constants of a primary side circuit of the output transformer T including a serial circuit of the resistor R and the coupling capacitance C1 and a secondary side circuit of the output transformer including a self-inductance L2 and a load capacitance CL of the secondary side winding of the output transformer T are set such that a resonance frequency f0 of a circuit formed by the self-inductance L2 of the secondary side winding of the output transformer T and the load capacitance CL(F) of the electrostatic transducer is matched or approximately matched to a carrier wave frequency fc of the electrostatic transducer, wherein the carrier wave is a signal in an ultrasonic frequency band, wherein the electrostatic transducer comprises a first side fixed electrode in which a plurality of holes is formed; a second side fixed electrode in which a plurality of holes is formed, the first side fixed electrode and the second side fixed electrode forming a pair; and a vibration membrane which is interposed between the pair of fixed electrodes and has a conductive layer to which a direct current bias voltage is applied, and wherein the secondary side winding of the output transformer T has a center tap, one terminal of the secondary side winding of the output transformer T is connected to the first side fixed electrode and the other terminal thereof is connected to the second side fixed electrode, and the direct current bias voltage is applied from the center tap of the secondary side winding of the output transformer T to the conductive layer of the vibration membrane.

By this configuration, for example, in a push-pull type electrostatic transducer, one terminal of the secondary side winding of the output transformer T is connected to the front side (first side) fixed electrode, the other terminal thereof is connected to the rear side (second side) fixed electrode, and the direct current bias voltage is applied from the center tap of the secondary side winding of the output transformer T to the conductive layer of the vibration membrane. In addition, alternating current signals of which the phases are opposed to each other by 180 degrees are applied to the front side (first side) fixed electrode and the rear side (second side) fixed electrode through the output transformer T, respectively. Furthermore, the circuit constants are set such that the resonance frequency f0 of the circuit formed by the self-inductance L2 of the secondary side winding of the output transformer T and the load capacitance CL is matched or approximately matched to the carrier wave frequency fc of the electrostatic transducer.

Accordingly, in the push-pull type electrostatic transducer, the secondary side of the transformer T becomes the parallel resonance (antiresonance) state upon rated driving and current flowing into the primary side of the transformer T can be reduced while ensuring the predetermined output voltage (load terminal voltage). Therefore, the driving power of the electrostatic transducer can be reduced and thus the electrostatic transducer can be driven with low loss.

In addition, when the value of the primary side coupling capacitance C1 and the resistor R are properly set in conformity to the electric characteristic (circuit constant) of the output transformer and the load capacitance CL(F) of the electrostatic transducer, the driving frequency of the push-pull type electrostatic transducer is included in the pass band characteristic of the whole circuit.

According to the aspect of the invention, there is provided an ultrasonic speaker comprising: an electrostatic transducer which is driven by a boosted driving signal by boosting a modulated signal obtained by modulating a carrier wave with an acoustic signal in an audio frequency band and includes an output transformer T which connects the electrostatic transducer to a secondary side winding thereof in parallel and boosts the modulated signal, and a resistor R and a coupling capacitance C1 connected in series to a primary side winding of the output transformer T and in which a circuit constant of a primary side circuit of the output transformer T including a serial circuit of the resistor R and the coupling capacitance C1 and a circuit constant of a secondary side circuit of the output transformer including a self-inductance L2 and a load capacitance CL of the secondary side winding of the output transformer T are set such that a resonance frequency f0 of a circuit formed by the self-inductance L2 of the secondary side winding of the output transformer T and the load capacitance CL(F) of the electrostatic transducer is matched or approximately matched to a carrier wave frequency fc of the electrostatic transducer; an audio frequency signal source which generates a signal wave in an audio frequency band; a carrier wave signal source which generates and outputs a carrier wave in an ultrasonic frequency band; a modulator which modulates the carrier wave with the signal wave in the audio frequency band; and a power amplifier which amplifies the signal modulated by the modulator and applies the amplified signal to the primary side winding of the transformer T through the resistor R and the coupling capacitance C1.

By this configuration, in the driving circuit of the electrostatic transducer (load capacitance CL) for configuring the ultrasonic speaker, the electrostatic transducer is connected in parallel to the secondary side of the output transformer T and the resistor R and the coupling capacitance C1 are connected in series to the primary side of the output transformer T. Furthermore, the circuit constants are set such that the resonance frequency f0 of the circuit formed by the self-inductance L2 of the secondary side winding of the output transformer T and the load capacitance CL is matched or approximately matched to the carrier wave frequency fc of the electrostatic transducer. The carrier wave in the ultrasonic frequency band is modulated by the signal wave in the audio frequency band, the modulated signal is amplified by the power amplifier, and the amplified signal is applied to the primary side winding of the output transformer T through the resistor R and the coupling capacitance C1.

Accordingly, since the electrostatic transducer according to the aspect of the invention can be used in the ultrasonic speaker, it is possible to stable drive the ultrasonic speaker with low loss.

It is possible to use a push-pull type electrostatic transducer as the electrostatic transducer for configuring the ultrasonic speaker. In this case, one terminal of the secondary side winding of the output transformer T is connected to the front side (first side) fixed electrode, the other terminal thereof is connected to the rear side (second side) fixed electrode, and the direct current bias voltage is applied from the center tap of the secondary side winding of the output transformer T to the conductive layer of the vibration membrane. In addition, alternating current signals of which the phases are opposed to each other by 180 degrees are applied to the front side (first side) fixed electrode and the rear side (second side) fixed electrode through the output transformer T, respectively. Accordingly, it is possible to use the push-pull type electrostatic transducer in the ultrasonic speaker.

According to another aspect of the invention, there is provided a display device comprising: an ultrasonic speaker that includes an electrostatic transducer which is driven by a boosted driving signal by boosting a modulated signal obtained by modulating a carrier wave with an acoustic signal in an audio frequency band and includes an output transformer T which connects the electrostatic transducer to a secondary side winding thereof in parallel and boosts the modulated signal, and a resistor R and a coupling capacitance C1 connected in series to a primary side winding of the output transformer T and in which a circuit constant of a primary side circuit of the output transformer T including a serial circuit of the resistor R and the coupling capacitance C1 and a circuit constant of a secondary side circuit of the output transformer including a self-inductance L2 and a load capacitance CL of the secondary side winding of the output transformer T are set such that a resonance frequency f0 of a circuit formed by the self-inductance L2 of the secondary side winding of the output transformer T and the load capacitance CL(F) of the electrostatic transducer is matched or approximately matched to a carrier wave frequency fc of the electrostatic transducer, an audio frequency signal source which generates a signal wave in an audio frequency band, a carrier wave signal source which generates and outputs a carrier wave in an ultrasonic frequency band, a modulator which modulates the carrier wave with the signal wave in the audio frequency band, and a power amplifier which amplifies the signal modulated by the modulator and applies the amplified signal to the primary side winding of the transformer T through the resistor R and the coupling capacitance C1; and a projection optical system which projects an image onto a projection surface.

By this configuration, the ultrasonic speaker used in the display device includes the electrostatic transducer, the electrostatic transducer (load capacitance CL) is connected in parallel to the secondary side of the output transformer T as the driven load and the resistor R and the coupling capacitance C1 are connected in series to the primary side of the output transformer T. Furthermore, the circuit constants are set such that the resonance frequency f0 of the circuit formed by the self-inductance L2 of the secondary side winding of the output transformer T and the load capacitance CL is matched or approximately matched to the carrier wave frequency (driving frequency) fc of the electrostatic transducer. The carrier wave in the ultrasonic frequency band is modulated by the signal wave in the audio frequency band, the modulated signal is amplified by the power amplifier, and the amplified signal is applied to the primary side winding of the output transformer T through the resistor R and the coupling capacitance C1. In addition, the audio signal supplied from the acoustic source is reproduced by the ultrasonic speaker.

Accordingly, it is possible to use the ultrasonic speaker which has the flat output voltage frequency characteristic and can be driven with low loss in the display device. Therefore, the acoustic signal having a sufficient sound pressure and a wideband characteristic can be reproduced on a sound wave reflection surface such as a screen as if there is a virtual sound source. In addition, the reproduction range can be easily controlled.

In addition, it is possible to use a push-pull type electrostatic transducer as the electrostatic transducer for configuring the ultrasonic speaker. In this case, one terminal of the secondary side winding of the output transformer T is connected to the front side (first side) fixed electrode, the other terminal thereof is connected to the rear side (second side) fixed electrode, and the direct current bias voltage is applied from the center tap of the secondary side winding of the output transformer T to the conductive layer of the vibration membrane. In addition, alternating current signals of which the phases are opposed to each other by 180 degrees are applied to the front side (first side) fixed electrode and the rear side (second side) fixed electrode through the output transformer T, respectively. Accordingly, it is possible to use the ultrasonic speaker including the push-pull type electrostatic transducer in the display device.

According to the aspect of the invention, there is provided a directional acoustic system which reproduces an audio signal supplied from an acoustic source and forms a virtual sound source in the vicinity of a sound wave reflection surface including a screen, by an ultrasonic speaker which includes an electrostatic transducer which is driven by a boosted driving signal by boosting a modulated signal obtained by modulating a carrier wave with an acoustic signal in an audio frequency band and includes an output transformer T which connects the electrostatic transducer to a secondary side winding thereof in parallel and boosts the modulated signal, and a resistor R and a coupling capacitance C1 connected in series to a primary side winding of the output transformer T and in which a circuit constant of a primary side circuit of the output transformer T including a serial circuit of the resistor R and the coupling capacitance C1 and a circuit constant of a secondary side circuit of the output transformer including a self-inductance L2 and a load capacitance CL of the secondary side winding of the output transformer T are set such that a resonance frequency f0 of a circuit formed by the self-inductance L2 of the secondary side winding of the output transformer T and the load capacitance CL(F) of the electrostatic transducer is matched or approximately matched to a carrier wave frequency fc of the electrostatic transducer, an audio frequency signal source which generates a signal wave in an audio frequency band, a carrier wave signal source which generates and outputs a carrier wave in an ultrasonic frequency band, a modulator which modulates the carrier wave with the signal wave in the audio frequency band, and a power amplifier which amplifies the signal modulated by the modulator and applies the amplified signal to the primary side winding of the transformer T through the resistor R and the coupling capacitance C1, the system comprising: the ultrasonic speaker which reproduces a signal in a first sound range of the audio signal supplied from the acoustic source; and a speaker for reproducing a low frequency sound, which reproduces a signal in a second sound range lower than the first sound range of the audio signal supplied from the acoustic source.

By this configuration, the ultrasonic speaker used in the directional acoustic system includes the electrostatic transducer, the electrostatic transducer (load capacitance CL) is connected in parallel to the secondary side of the output transformer T as the driven load and the resistor R and the coupling capacitance C1 are connected in series to the primary side of the output transformer T. Furthermore, the circuit constants are set such that the resonance frequency f0 of the circuit formed by the self-inductance L2 of the secondary side winding of the output transformer T and the load capacitance CL is matched or approximately matched to the carrier wave frequency (driving frequency) fc of the electrostatic transducer. The carrier wave in the ultrasonic frequency band is modulated by the signal wave in the audio frequency band, the modulated signal is amplified by the power amplifier, and the amplified signal is applied to the primary side winding of the output transformer T through the resistor R and the coupling capacitance C1. In addition, the audio signal in an intermediate and high frequency range (first range) supplied from the acoustic source is reproduced by the ultrasonic speaker. Furthermore, the audio signal in a low frequency range (second range) supplied from the acoustic source is reproduced by the speaker for reproducing the low frequency sound.

Accordingly, it is possible to use the ultrasonic speaker which has the flat output voltage frequency characteristic and can be driven with low loss in the directional acoustic system. Therefore, the acoustic signal having a sufficient sound pressure and a wideband characteristic can be reproduced from a virtual sound source provided in the vicinity of a sound wave reflection surface such as a screen. In addition, since the sound in the low frequency range is directly output from the speaker for reproducing the low frequency sound included in the acoustic system, the low frequency range can be reinforced and thus an acoustic field having high realistic sensation can be implemented.

In addition, it is possible to use a push-pull type electrostatic transducer as the electrostatic transducer for configuring the ultrasonic speaker of the directional acoustic system. In this case, one terminal of the secondary side winding of the output transformer T is connected to the front side (first side)

fixed electrode, the other terminal thereof is connected to the rear side (second side) fixed electrode, and the direct current bias voltage is applied from the center tap of the secondary side winding of the output transformer T to the conductive layer of the vibration membrane. In addition, alternating current signals of which the phases are opposed to each other by 180 degrees are applied to the front side (first side) fixed electrode and the rear side (second side) fixed electrode through the output transformer T, respectively. Accordingly, it is possible to use the push-pull type electrostatic transducer in the directional acoustic system.

BRIEF DESCRIPTION OF THE DRAWINGS

The invention will be described with reference to the accompanying drawings, wherein like numbers reference like elements.

DESCRIPTION OF EXEMPLARY EMBODIMENTS

Description of Driving Circuit of Electrostatic Transducer According to the Invention First, a driving circuit of an electrostatic transducer (capacitive load) according to the invention will be described.

The electrostatic transducer according to the invention has three points.

In a first point, a signal is applied to the electrostatic transducer by an output transformer to perform boosting and impedance-conversion of the signal by the output transformer. Accordingly, it is possible to obtain a high output sound pressure.

In a second point, a constant of the transformer is set (designed) such that a resonance frequency band of a resonance circuit formed by the output transformer and a load capacitance (electrostatic transducer) is matched to a carrier wave frequency band of the electrostatic transducer. Accordingly, since impedance of a load side in the vicinity of the carrier wave frequency increases, it is possible to reduce the power consumption in an amplifier to accomplish low loss.

In a third point, by connecting a resistor and a capacitor having proper values to a primary side of the output transformer, it is possible to realize a BPF characteristic (flat output characteristics) due to a coupling circuit of the transformer together with a load capacitance connected to a secondary side of the transformer. Accordingly, it is possible to obtain the flat output characteristic.

Next, a preferred embodiment of the invention will be described with reference to the attached drawings.

Figure 1A:
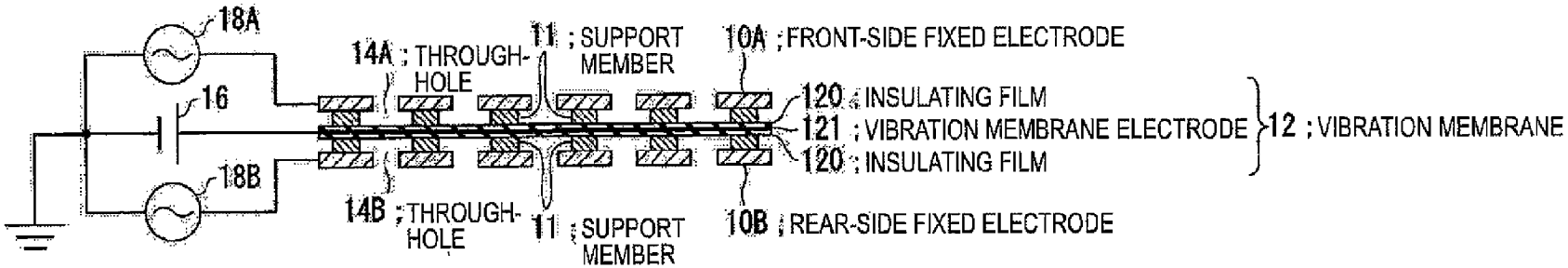
FIGS. 1A to 1C are views showing an example of an electrostatic transducer according to an embodiment of the invention.
Figure 1B:
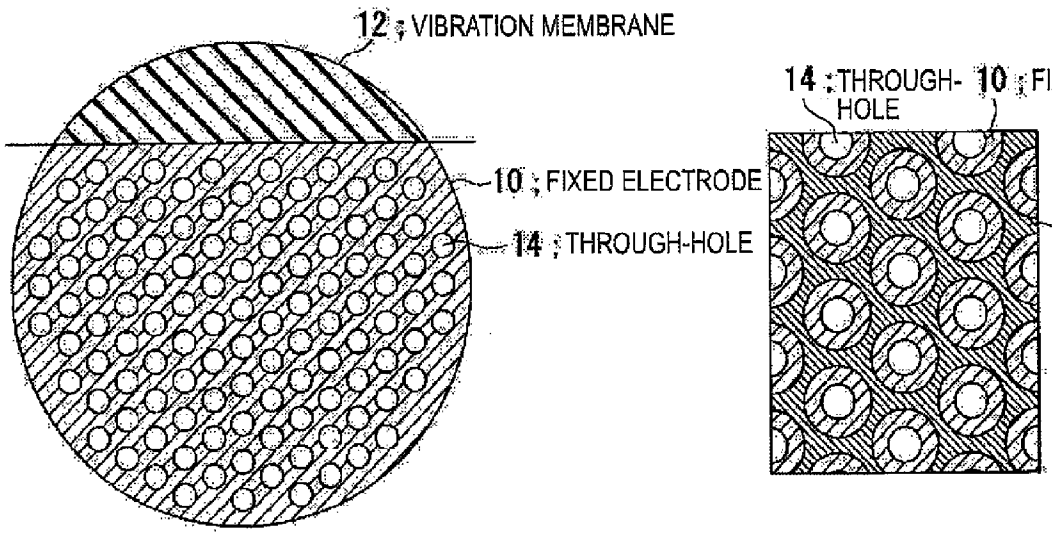
Figure 1C:
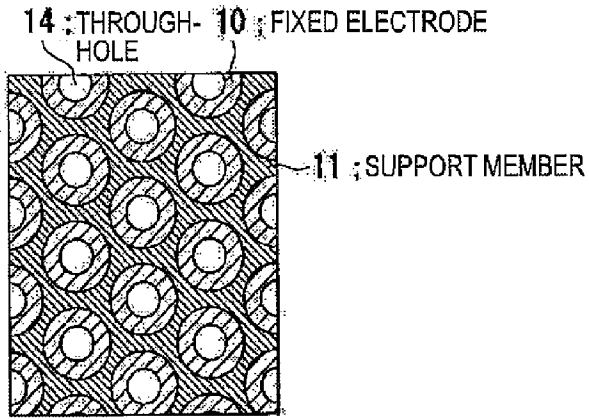

FIGS. 1A to 1C are views showing an example of an electrostatic transducer according to the invention, which is suitably used as a transducer of an ultrasonic speaker. FIG. 1A is a cross sectional view of the transducer, which includes a vibration membrane 12 having a conductive layer and a pair of fixed electrodes including a front (first surface) fixed electrode 10A and a rear (second surface) fixed electrode 10B which face each other through the vibration membrane 12 (both the front-side fixed electrode 10A and the rear-side fixed electrode 10B are collectively called fixed electrode 10). The vibration membrane 12 may be formed of insulating films 120 with the conductive layer (vibration membrane electrode) 121 interposed therebetween, as shown in FIG. 1A, or the entire vibration membrane 12 may be formed of a conductive material.

A plurality of through-holes 14A are provided in the front-side fixed electrode 10A for sandwiching the vibration membrane 12. A plurality of through-holes 14B having the same shape are provided in the rear-side fixed electrode 10B in positions facing the respective through-holes 14A provided in the front-side fixed electrode 10A (both the through-hole 14A and the through-hole 14B are collectively called the through-hole 14). The front-side fixed electrode 10A and the rear-side fixed electrode 10B are supported by support members 11 with a predetermined gap from the vibration membrane 12, and, as shown in FIG. 1A, the support members 11 are formed such that the vibration membrane 12 and the fixed electrode face each other with the gap.

FIG. 1B shows a one-side plan appearance of the transducer (in a state where a portion of the fixed electrode 10 is cut to expose the vibration membrane) and the plurality of through-holes 14 are arranged in a honeycomb shape. FIG. 1C is a plan view of the fixed electrode 10 attached with the support member 11 and shows a state where the fixed electrode is viewed from the vibration membrane of the transducer. The support member 11 is formed of an insulating material and can be formed by pattern-printing the insulating material on the fixed electrode surface (facing the vibration membrane), for example, in a manner for printing a resist on a printed board.

In addition, a direct current source 16 is a power supply for applying a direct current bias voltage to the vibration membrane electrode 121 and alternating current signals 18A and 18B are signals applied to the front-side fixed electrode 10A and the rear-side fixed electrode 10B in order to drive the vibration membrane 12.

Figure 2:
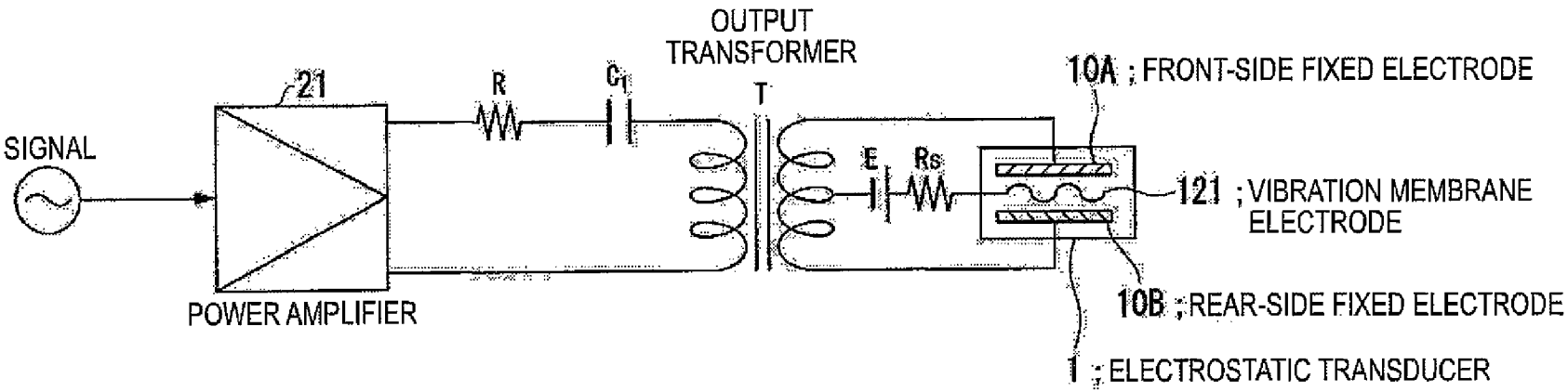
FIG. 2 is a view showing the configuration of a driving circuit of the electrostatic transducer.

FIG. 2 is a view showing the configuration of a driving circuit of the electrostatic transducer. In the circuit shown in FIG. 2, an output from a power amplifier 21 is boosted by an output transformer T to be applied to the electrostatic transducer 1. A resistor R and a capacitor C1 are connected in series with a primary side winding of the output transformer T. One terminal of a secondary side winding of the output transformer T is connected to the front-side fixed electrode 10A of the electrostatic transducer 1 and the other terminal thereof is connected to the rear-side fixed electrode 10B. That is, the electrostatic transducer 1 is connected in parallel with the secondary side winding of the output transformer T. In addition, a center tap is provided in the secondary side winding of the output transformer T and a direct current bias voltage E is applied from the center tap to the vibration membrane electrode 121 of the electrostatic transducer 1 through a resistor Rs. The resistor Rs is not directly related to the invention and thusmay be omitted.

The alternating currents having a same amplitude and opposite phases are applied from the center tap to the front-side fixed electrode 10A and the rear-side fixed electrode 10B of the electrostatic transducer 1. By applying the direct current bias voltage E to the vibration membrane electrode 121 and applying the driving signals (alternating current signals) having opposite phases to the front-side fixed electrode 10A and the rear-side fixed electrode 10B, electrostatic attraction and electrostatic repulsion simultaneously occur in the vibration membrane in a same direction. Whenever the polarity of the driving signal (alternating current signal) is inverted, the directions of the electrostatic attraction and the electrostatic repulsion vary and thus the vibration membrane is push-pull-driven. As a result, a sound wave generated at the vibration membrane is emitted through the through-holes 14 (FIGS. 1A to 1C) provided in the front-side fixed electrode 10A and the rear-side fixed electrode 10B. By push-pull-driving the vibration membrane, the electrostatic ultrasonic transducer shown in FIGS. 1A to 1C is called a push-pull type electrostatic ultrasonic transducer.

Figure 3:
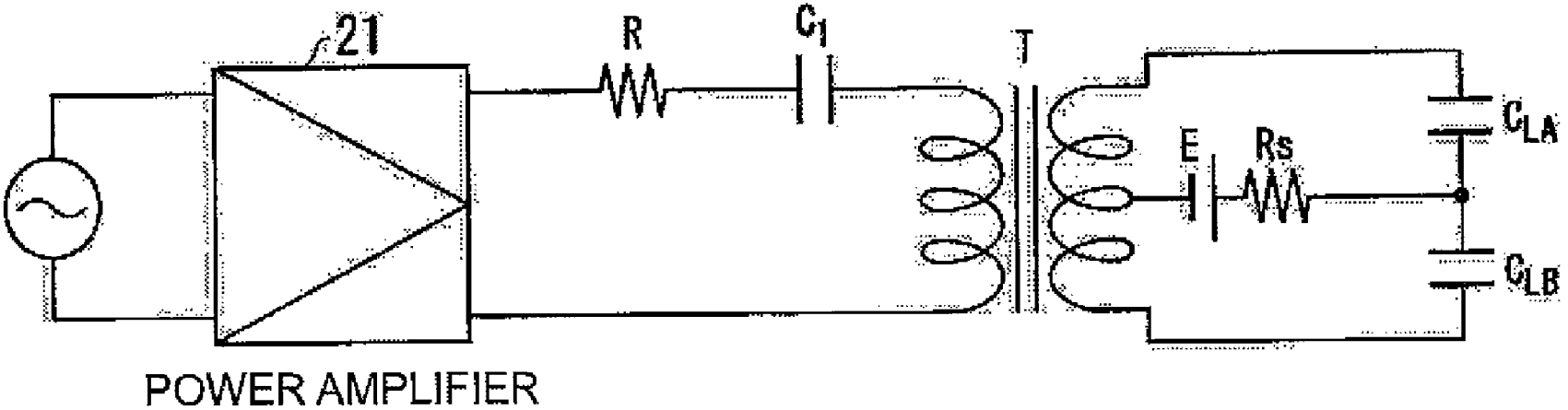
FIG. 3 is a view showing an equivalent circuit of a portion of the electrostatic transducer.

FIG. 3 is a view showing an equivalent circuit of a portion of the electrostatic transducer 1 shown in FIG. 2. In the electrostatic transducer 1, since capacitors are respectively formed between the vibration membrane electrode and the both fixed electrodes, the equivalent circuit can be expressed by load capacitances CLA and CLB connected in series, as shown in FIG. 3.

Next, a method for setting a circuit constant and the operation of the circuit will be described in detail.

Figure 4:
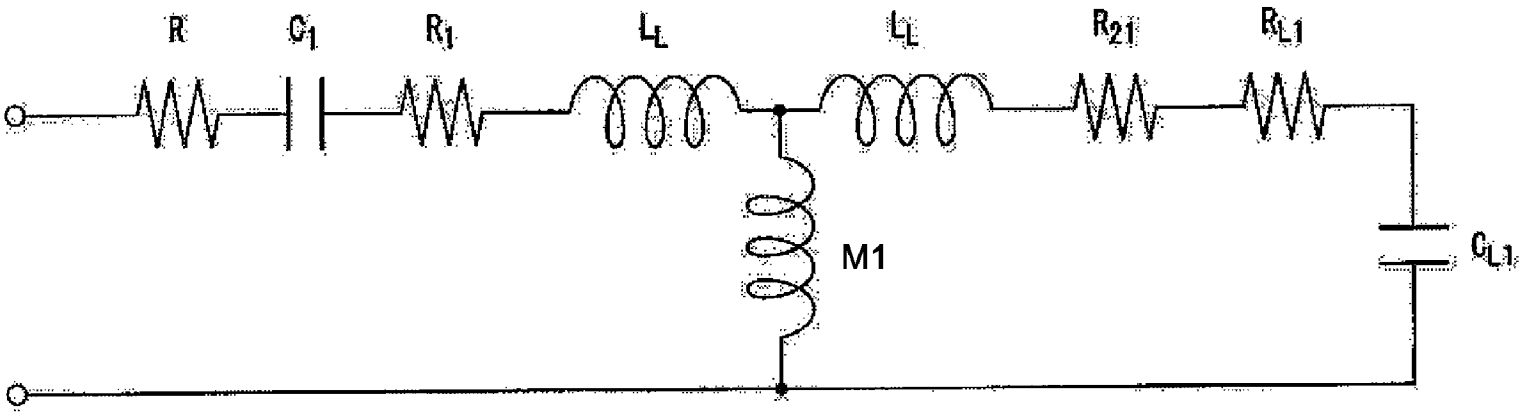
FIG. 4 is a view showing an equivalent circuit of the driving circuit of the electrostatic transducer.

FIG. 4 is a view showing an equivalent circuit of the driving circuit of the electrostatic transducer, that is, an equivalent circuit of the driving circuit of the electrostatic transducer obtained by converting a circuit of the secondary side of the output transformer T into the primary side.

Here, R denotes a primary side external resistor, C1 denotes a primary side coupling capacitance, R1 denotes a resistor of the primary side winding of the output transformer T, N1 denotes a winding number of the primary side winding of the output transformer T, N2 denotes a winding number of the secondary side winding of the output transformer T, L1 denotes a primary side self-inductance of the output transformer T, L2 denotes a secondary side self-inductance of the output transformer T, M1 denotes a mutual inductance of the output transformer T converted into the primary side, LL denotes a leakage inductance of the output transformer T (primary side inductance when the secondary side winding is short-circuited), R21 denotes a resistor of the secondary side winding of the output transformer T converted into the primary side, RL1 denotes a load resistor converted into the primary side (resistance component of the electrostatic transducer), CL denotes a total load capacitance of the electrostatic transducer (total capacitance of the load capacitances CLA and CLB shown in FIG. 3), and CL1 denotes a total capacitance of the electrostatic transducer when CL is converted into the primary side, which satisfy the following Equation 1.

$$M_1 = L_1 - L_L \qquad \text{Equation 1}$$

$$R_{21} = \left(\frac{N_1}{N_2}\right)^2 R_2$$

$$R_{L1} = \left(\frac{N_1}{N_2}\right)^2 R_L$$

$$C_{L1} = \left(\frac{N_2}{N_1}\right)^2 C_L$$

Now, the electrostatic transducer, which is a load, has the total capacitance CL(F) and is driven by a rated carrier wave frequency fc(Hz). At this time, the self-inductance L2 of the secondary side winding of the output transformer T is expressed by Equation 2.

$$L_2 = \frac{1}{4\pi^2 f_c^2 C_L} \qquad \text{Equation 2}$$

By this configuration, upon normal (rated) driving, the secondary side of the transformer becomes a parallel resonance (antiresonance) state and the impedance of the circuit viewed from the primary side of the transformer (power amplifier side) increases. As a result, upon rated driving, since current flowing in the primary side of the transformer can be reduced while ensuring a desired output voltage (load terminal voltage), the power consumption in the power amplifier decreases and thus the system can be wholly driven with low loss.

For example, when the total capacitance CL of the electrostatic transducer is 5 nF and the rated carrier wave frequency fc is 50 kHz, the secondary side self-inductance L2 of the output transformer T is preferably about 2 mH from Equation 2.

Next, a voltage boosting ratio (winding specification) of the output transformer is determined. When a maximum application voltage of the electrostatic transducer (secondary side maximum voltage of the transformer) is V2 and a maximum output voltage of the power amplifier is V1, the boosting ratio A of the transformer is set to the following Equation 3.

$$A \geq \frac{V_2}{V_1} \qquad \text{Equation 3}$$

The specification (winding number) of the primary side winding and the secondary side winding and the specification (material and shape) of a core are determined so as to simultaneously satisfy the necessary voltage boosting ratio A and the self-inductance L2 of the secondary side winding.

When the specifications of the winding and the core of the output transformer are determined, the leakage inductance of the transformer is simultaneously obtained. The leakage inductance depends on the material and the shape of the core and the winding specification of the output transformer T.

Here, when a specific example of setting the circuit constant is described, the specification of the output transformer T is, for example, set to A=10, L1=20 μH, L2=2 mH, LL=0.4 μH, R1=20 mΩ, and R2=0.8Ω and the following description will be made.

When the leakage inductance is obtained, the coupling capacitance C1 is determined. Here, the value of the coupling capacitance C1 is set such that a voltage pass band characteristic of a serial resonance circuit (HPF) formed by C1 and L1(=M1+LL) and a voltage pass band characteristic of a serial resonance circuit (LPF) formed by CL1 and LL are approximately symmetrical based on a resonance frequency f0 of a parallel resonance circuit formed by M1 and CL1.

Figure 5:
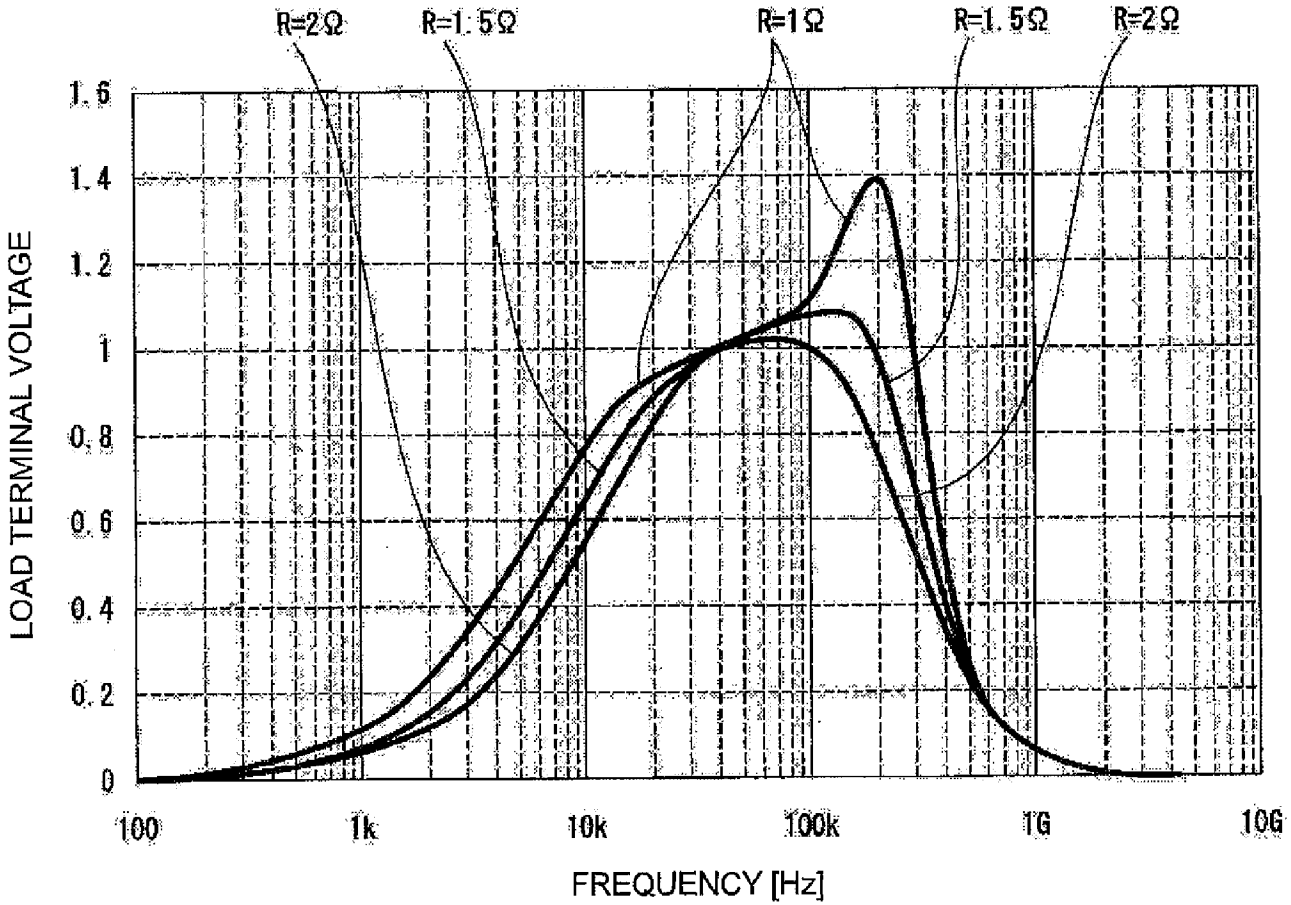
FIG. 5 is a view showing a pass band characteristic of the whole circuit when a coupling capacitance C1 does not exist.

FIG. 5 is a view showing a pass band characteristic of the whole circuit when the coupling capacitance C1 does not exist. It can be seen that a large peak appears in the vicinity of 200 kHz by influence of the resonance due to the load capacitance CL1 and the leakage inductance LL of the output transformer T (seen a case of R=1Ω). By increasing the value of the resistor R, a response becomes smooth, but an ever-increasing characteristic appears wholly. Accordingly, it can be seen that there is no a condition that the pass band becomes flat.

In the invention, by adding the coupling capacitance to the primary side of the transformer, a resonance system having a high pass filter (HPF) characteristic at the primary side of the transformer is configured. By combining the secondary side resonance system (LPF) of the transformer shown in FIG. 5 and the primary side resonance system using the transformer, a wholly flat band pass filter (BPF) characteristic is realized.

Here, when a low side band frequency of a frequency in which the current value is attenuated by 3 dB is f1LL in the HPF and a high side band frequency of the frequency in which the current value is attenuated by 3 dB is f2H in the LPF, the value of C1 is set such that the following Equation 4 is satisfied.

$$\left(\frac{f_{2+}}{f_0}\right)\Big/\left(\frac{f_0}{f_{1-}}\right) = \frac{f_{1-}f_{2+}}{f_0^2} = 1 \qquad \text{Equation 4}$$

A resonance frequency f1(Hz) of a serial resonance circuit (HPF) formed by C1, LL and M1 is given by the following Equation 5:

$$f_1 = \frac{1}{2\pi\sqrt{(M_1 + L_L)C_1}}$$

and a resonance frequency f2(Hz) of a serial resonance circuit (LPF) formed by C1, LL and CL1 is given by the following Equation 6.

$$f_2 = \frac{1}{2\pi\sqrt{\frac{2L_L C_1 C_{L1}}{C_1 \div C_{L1}}}}$$

A resonance frequency f0(Hz) of a parallel resonance circuit formed by M1, LL and CL1 is given by the following Equation 7.

$$f_0 = \frac{1}{2\pi\sqrt{(M_1 + L_L)C_{L1}}} \qquad \text{Equation 7}$$

Since quality factors Q1 and Q2 of the HPF and the LPF are respectively given by the following equations (Equation 8), $$Q_1 = \frac{\sqrt{\frac{M_1 + L_L}{C_1}}}{R + R_1}, \quad Q_2 = \frac{\sqrt{\frac{2L_L(C_1 + C_{L1})}{C_1 C_{L1}}}}{R + R_1 + R_{21}} \qquad \text{Equation 8}$$

half bandwidths B1 and B2 of the HPF and the LPF are respectively given by the following equations (Equation 9).

$$B_1 = \frac{f_1}{Q_1} = \frac{R + R_1}{2\pi(M_1 + L_L)}, \quad B_2 = \frac{f_2}{Q_2} = \frac{R + R_1 \div R_{21}}{4\pi L_L} \qquad \text{Equation 9}$$

In the HPF, when the low side band frequency in which the current value is attenuated by 3 dB is low side −3 dB attenuation frequency f1L and the high side band frequency in which the current value is attenuated by 3 dB is high side −3 dB attenuation frequency f1H, the relationship between f1L and f1+ as represented by Equation 10 is obtained.

$$B_1 = f_{1+} - f_{1-}$$
$$f_1^2 = f_{1+} f_{1-} \qquad \text{Equation 10}$$

These simultaneous equations are arranged with respect to the low side −3 dB attenuation frequency f1L, Equation 11 is obtained.

$$f_{1-}^2 + B_1 f_{1-} - f_1^2 = 0 \qquad \text{Equation 11}$$

When Equation 11 is solved, the −3 dB low frequency f1L is given by Equation 12.

$$f_{1-} = \frac{\sqrt{B_1^2 + 4f_1^2} - B_1}{2} \qquad \text{Equation 12}$$

Similarly, the high side −3 dB attenuation frequency f2H in which the current value is attenuated by 3 dB in the LPF is given by Equation 13.

$$f_{2+} = \frac{\sqrt{B_2^2 + 4f_2^2} + B_2}{2} \qquad \text{Equation 13}$$

As described above, since a condition for allowing the pass band characteristic of the HPF and the pass band characteristic of the LPF to be approximately symmetrical is f1L·f2H/f0$^2$=1, a symmetry property between the pass band characteristic of the HPF and the pass band characteristic of the LPF is obtained by Equation 14.

$$\frac{f_{1-}f_{2+}}{f_0^2} = \frac{\left(\sqrt{B_1^2+4f_1^2}-B_1\right)\left(\sqrt{B_2^2+4f_2^2}+B_2\right)}{4f_0^2} = 1 \quad \text{Equation 14}$$

In order to satisfy Equation 14, the value of the coupling capacitance C1 is set.

Figure 6:
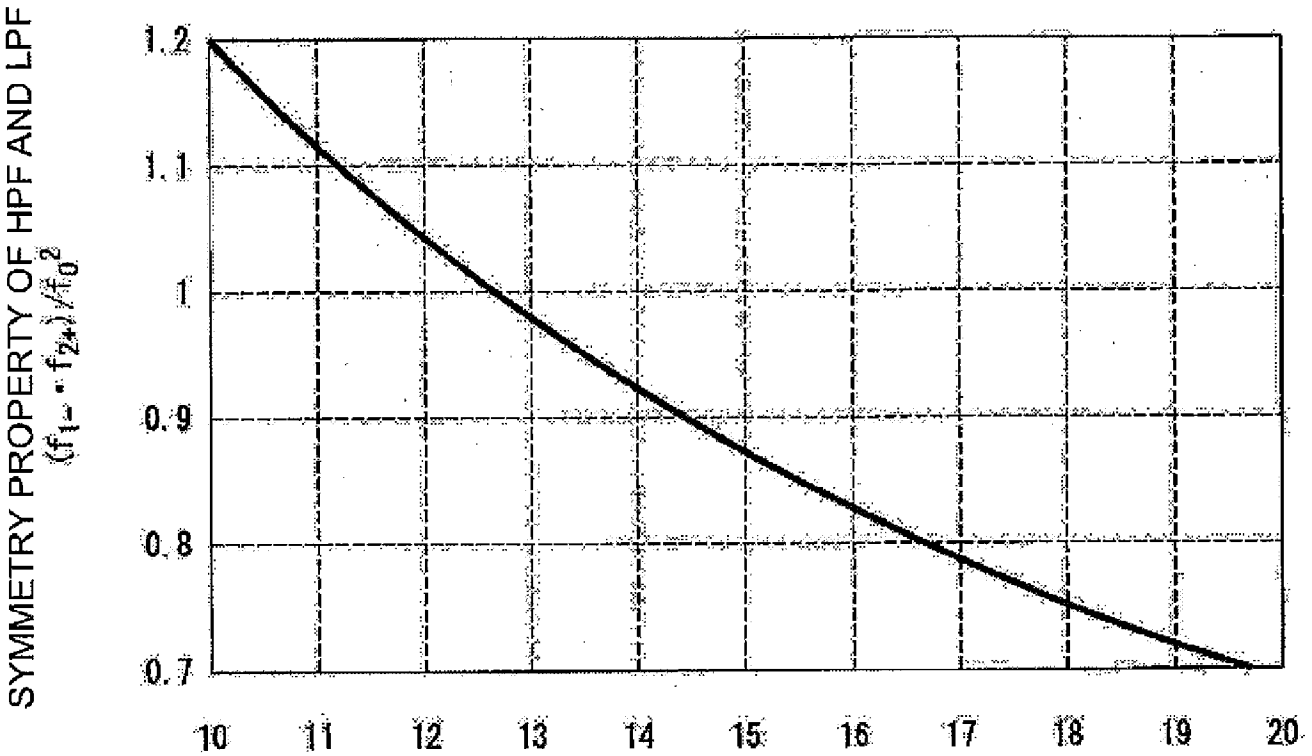
FIG. 6 is a view showing a symmetry property of pass band characteristics of a HPF and a LPF and the coupling capacitance.

FIG. 6 is a view showing the symmetry property between pass band characteristics of the HPF and the LPF and the coupling capacitance C1. For example, when the output transformer T having the above numerical specifications is used, f1L·f2H/f0$^2$=1 varies depending on the value of the coupling capacitance C1, as shown in FIG. 6. Accordingly, from the symmetry property, it can be seen that C1=12.7 μF may be set.

Figure 7:
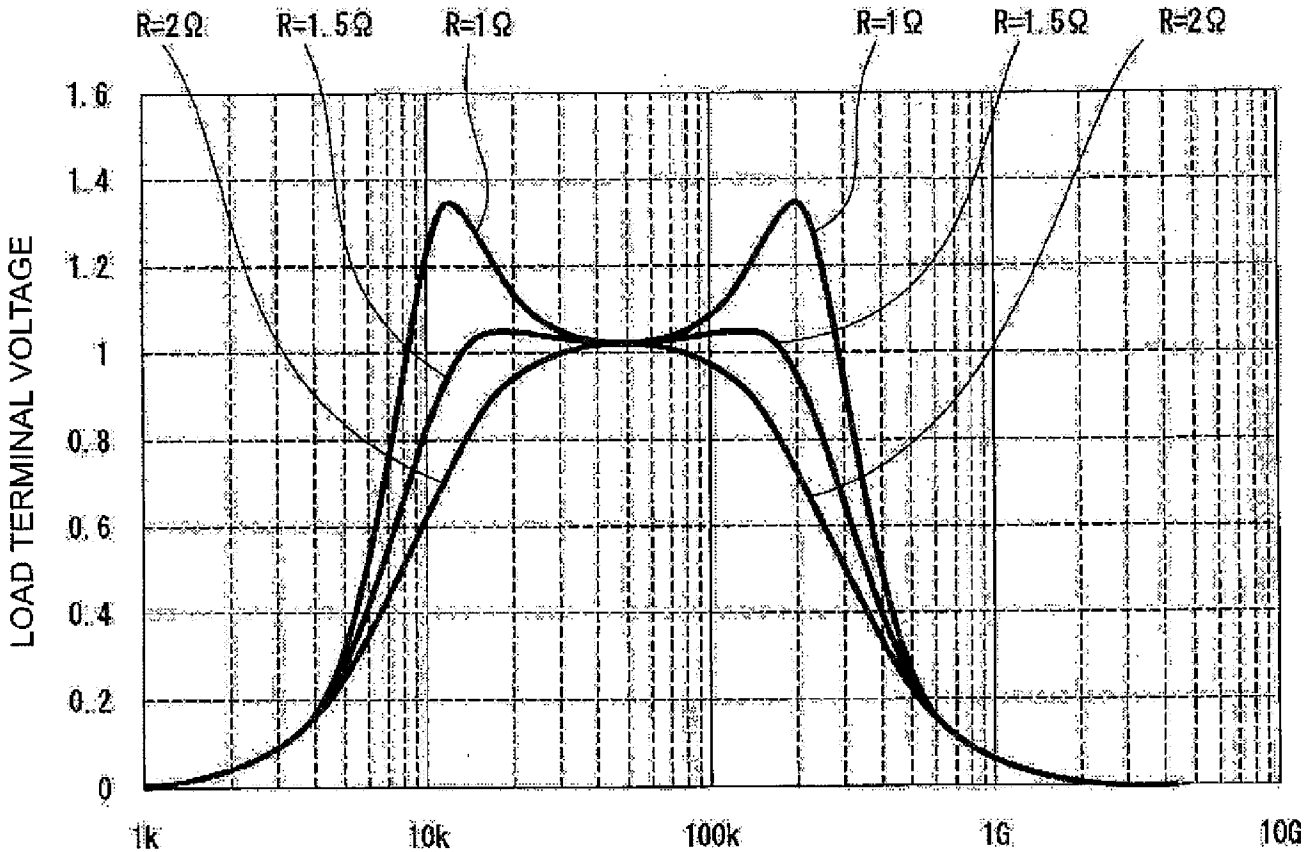
FIG. 7 is a view showing the pass band characteristic of the whole circuit.

FIG. 7 is a view showing the pass band characteristic of the whole circuit and shows the frequency characteristic (pass band characteristic of the whole circuit) of the load terminal voltage when C1=12.7 μF (In addition, in the graph shown in FIG. 7, the voltage boosting ratio of the transformer is ignored). In FIG. 7, it can be seen that a circumpolar response characteristic significantly varies depending on the resistor R, but a symmetrical response occurs in the vicinity of the parallel resonance frequency f0=50 kHz of the circuit even in any case, compared with FIG. 5.

As can be seen from FIG. 7, the pass band characteristic (output characteristic) significantly varies depending on the value of the resistor R. Since it is preferable that the pass band characteristic is flat in the whole circuit of the electrostatic transducer, the value of the primary side external resistor R need be properly set such that the pass band characteristic becomes flat.

The circuit according to the invention is a combination circuit obtained by combining the resonance circuit (HPF) formed at the primary side of the transformer and the resonance circuit (LPF) formed at the secondary side of the transformer through the transformer. Since the HPF and the LPF are combined, the band pass filter characteristic (BPF characteristic) occurs in the whole circuit, but the pass band characteristic (flatness) significantly varies depending on the resonance characteristic (resonance sharpness what is called quality factor) of each resonance circuit.

The pass band characteristic becomes flat when the HPF and the LPF become critical coupling states, and a product between the coupling coefficient of the transformer and the quality factor of the circuit load becomes 1.

In order to make the filters to the critical coupling state, a peak of the response characteristic must not appear in the vicinity of the resonance frequencies of the HPF and the LPF. When the quality factor of the filter is less than or equal to 1/√2, the peak does not exist in the response of the filter. Accordingly, when the values represented by the following Equation 15 are respectively 1, the response of the pass band of each filter is flat (the peak does not exist).

$$Q_{1L} = \sqrt{2}\,kQ_1 \quad \text{Equation 15}$$
$$Q_{2L} = \sqrt{2}\,kQ_2$$

Figure 8:
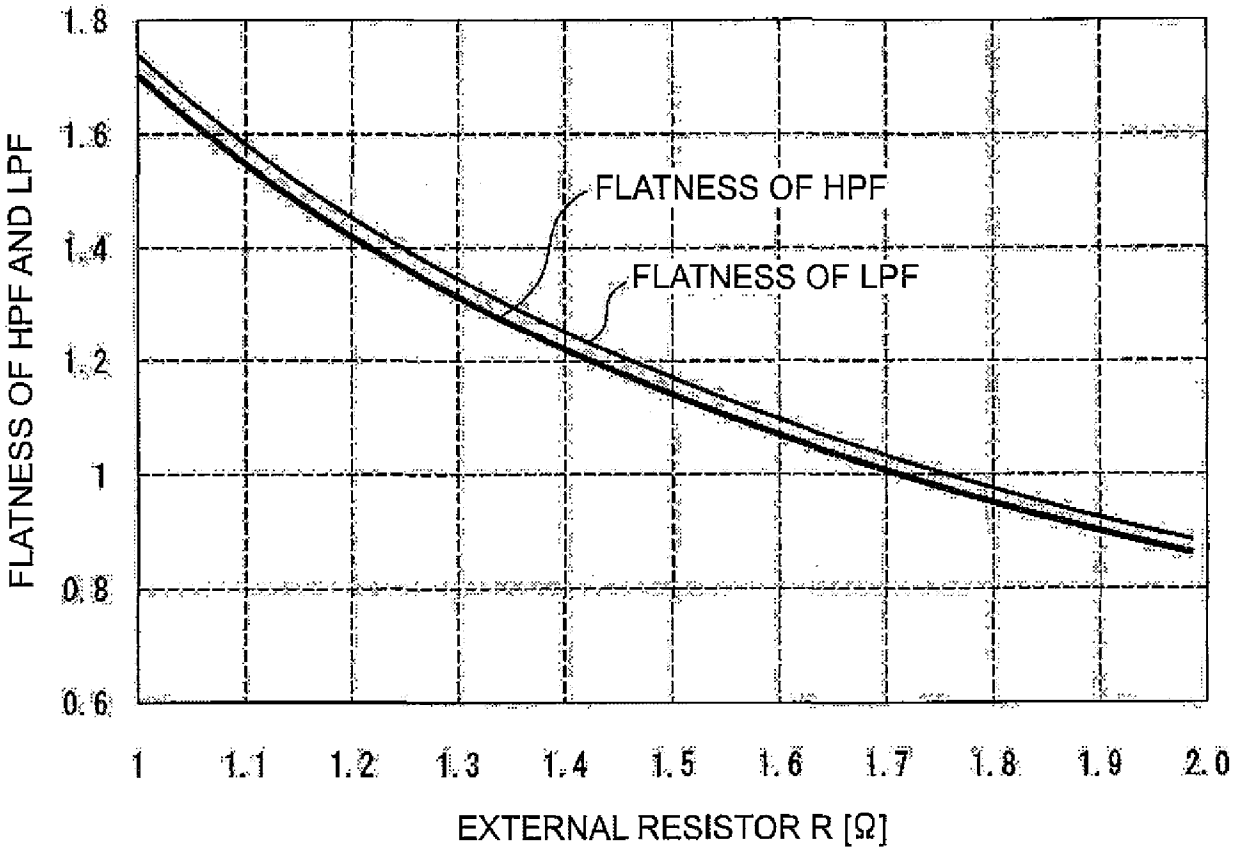
FIG. 8 is a view showing a relationship between a primary side resistor and flatness of the pass band characteristic.

In addition, when an additional resistor is not separately connected to the secondary side of the characteristics of the HPF and the LPF. For example, when the output transformer T having the numerical specification (A=10, L1=20 μH, L2=2 mH, LL=0.4 μh, R1=20 mΩ, and R2=0.8Ω) is used, the values of the parameter Q1L showing the flatness of the HPF and the parameter Q2L showing the flatness of the LPF vary depending on the value of the resistor R as shown in FIG. 8 (But, C1=12.7 μF). Accordingly, from the condition of the flatness, it can be seen that R=1.72Ω is set.

In addition, in the present embodiment, since the output impedance of the power amplifier is ignorable with respect to the resistor R, the circuit constant is set in no consideration of the output impedance of the power amplifier. However, when the output impedance of the power amplifier has considerably a large value, it is preferable that the circuit constant is set in consideration of the impedance of the power amplifier.

As described above, it is possible to set the value of the resistor R and the value of the coupling capacitance C1, which make the pass band characteristic of the whole circuit flat.

Figure 9:
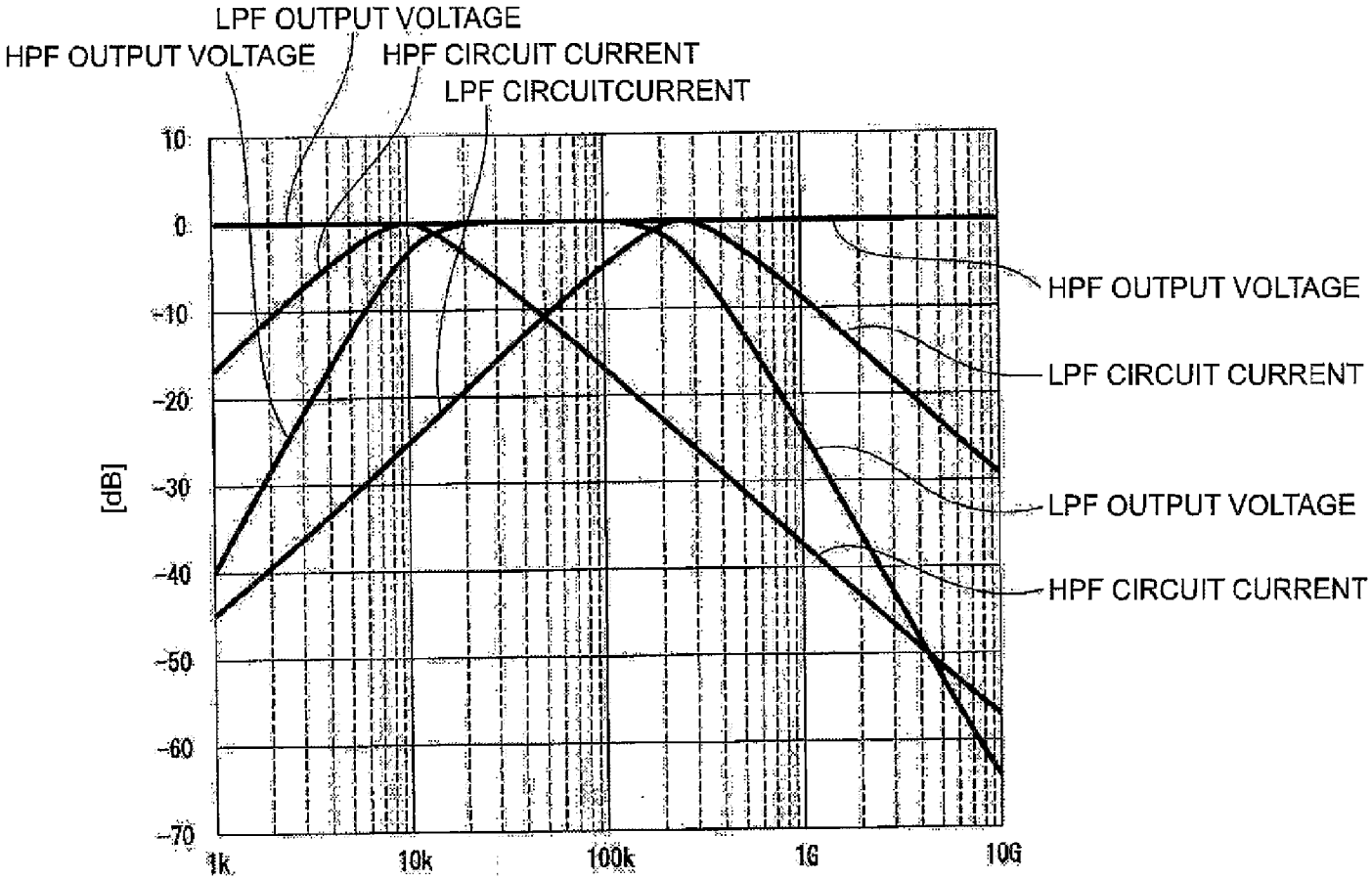
FIG. 9 is a view showing resonance characteristics and pass band characteristics of the HPF and the LPF.

FIG. 9 is a view showing the resonance characteristics (circuit current frequency characteristics) and the pass band characteristics (filter output voltage frequency characteristics) of the HPF and the LPF when C1=12.7 μF and R=1.72Ω are set.

Figure 10:
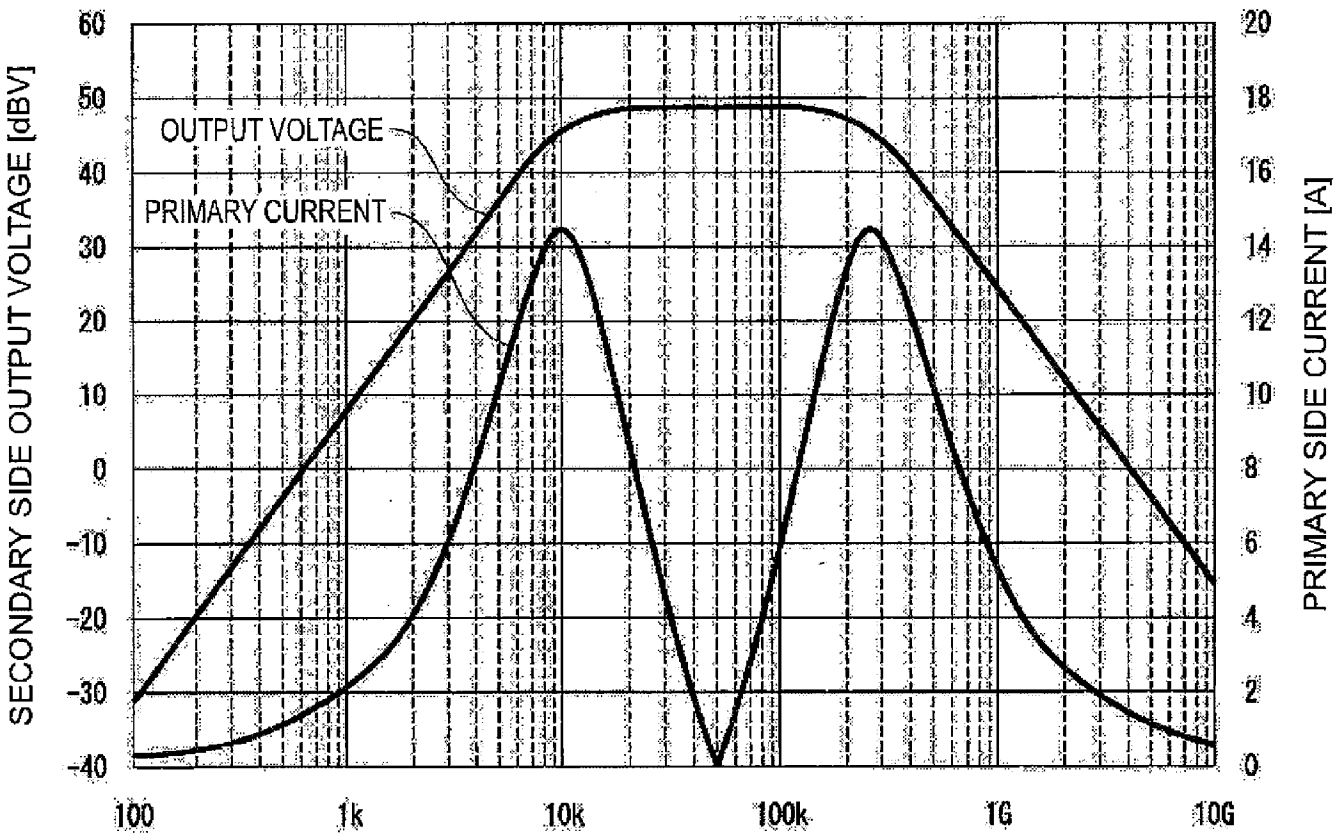
FIG. 10 is a view showing frequency characteristics of a primary side current and a secondary side output voltage.

FIG. 10 is a view showing a final output characteristic of the whole circuit, that is, the frequency characteristics of a primary side current and a secondary side output voltage (load terminal voltage). As can be seen from FIG. 10, the current (output current from the power amplifier) flowing into the primary side of the transformer becomes a minimum when the rated carrier wave frequency is 50 kHz. The output voltage characteristic of the pass band is flat up to about 20 kHz to 100 kHz (48 dBV=250V), the peak does not appear in the frequency characteristic, and an ideal BPF characteristic appears.

However, in the ultrasonic speaker having directivity, the output frequency characteristic of the driving circuit may be desired to be set so as to exclude an audio frequency band from the pass band, in order to reduce noise upon reproduction.

In the invention, it is possible to adjust the frequency width of the pass band by adjusting the value of the coupling coefficient (leakage inductance) of the transformer (for example, by adjusting the gap). An example in which the pass band characteristic of the whole circuit varies depending on the coupling coefficient of the transformer is shown in FIG. 11.

Figure 11:
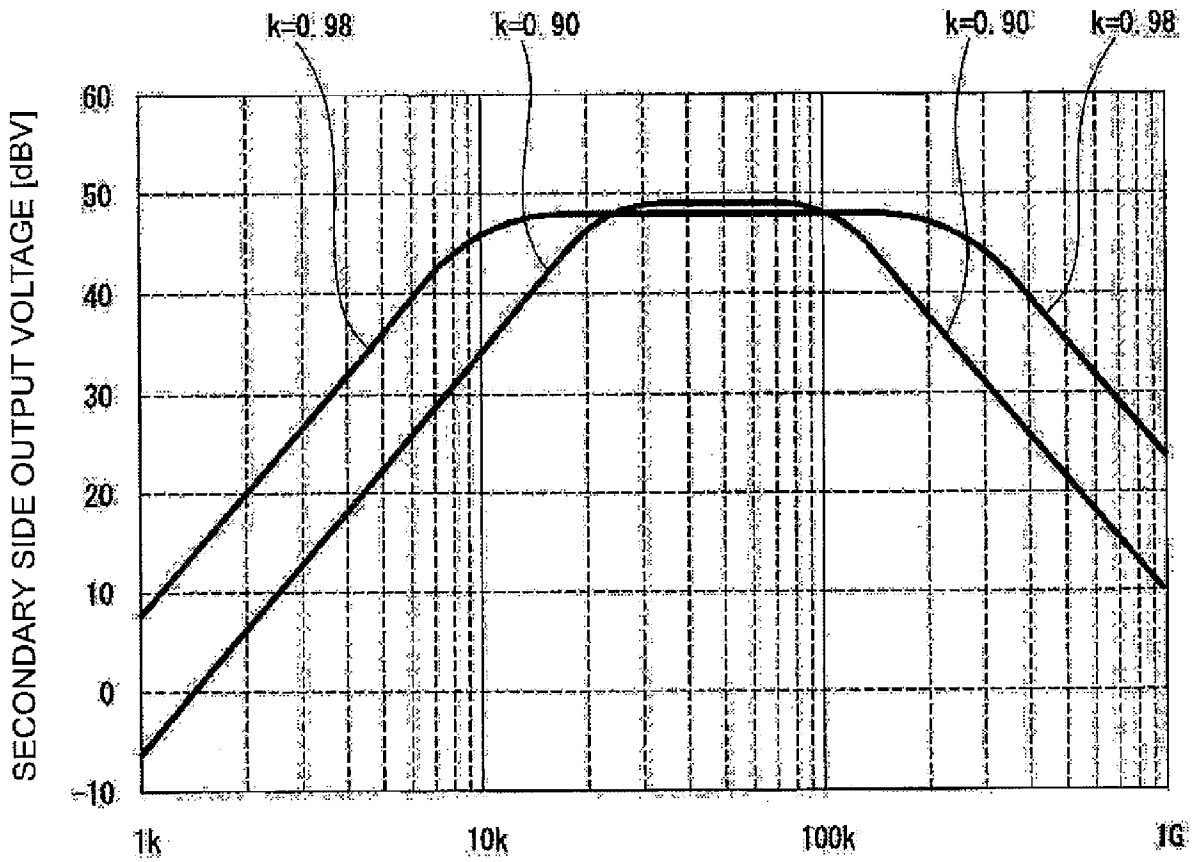
FIG. 11 is a view showing a relationship between a pass band and a coupling coefficient of a transformer.

FIG. 11 is a view showing a relationship between the pass band and the coupling coefficient of the transformer. When the coupling coefficient of the transformer decreases, the value of the leakage inductance increases. Accordingly, the quality factors of the HPF and the LPF increase and thus the resonance characteristic of each filter (resonance circuit) becomes sharper.

As can be seen from the equation of the resonance frequencies f1 and f2 of the HPF and the LPF, the value of f2 decreases by increasing the value of the leakage inductance LL. That is, the resonance frequency f2 of the LPF moves to the lower frequency, compared with a case where the coupling coefficient is large. Since the quality factor Q2 of the LPF also increases, the pass band characteristic of the LPF raises and thus the ever-increasing pass band characteristic appears in the whole circuit.

Although the coupling coefficient deceases, in order to realize the flat pass band characteristic, the value of the primary side coupling capacitance C1 is adjusted (decreased) such that the pass band characteristic of the HPF is symmetrical with the pass band characteristic of the LPF. When the value of C1 decreases, the value of the resonance frequency f1 of the HPF increases and thus the resonance frequency of the HPF moves to the higher frequency, compared with a case where the coupling coefficient is large.

As the coupling coefficient decreases (and peripheral circuit constant is also adjusted in conformity thereto), the resonance frequencies f1 and f2 of the HPF and the LPF move in respective center frequency (parallel resonance frequency f0) directions and thus the pass band width of the whole circuit becomes narrow. That is, by adjusting the coupling coefficient, it is possible to adjust the pass band to a desired width.

When the circuit constant is similarly obtained in the above-described sequence with respect to a case where the coupling coefficient is k=0.90, R=3.5Ω and C1=2.6 μF is obtained. The pass band characteristic is shown in FIG. 11 compared with the case of k=0.98.

In FIG. 11, it can seen that the center frequency f0=50 kHz of the pass band is uniform and the pass band width in the case of k=0.90 is narrower than that in the case of k=0.98. For usage as the ultrasonic speaker, the case of k=0.90 is preferable because the attenuation characteristic of the audio frequency band is excellent in view of the pass band characteristic. However, even when the coupling coefficient is small, the value of the resistor R need be large in order to flatten the pass band characteristic. Accordingly, when the coupling coefficient decreases, the loss due to the resistor increases.

Figure 12:
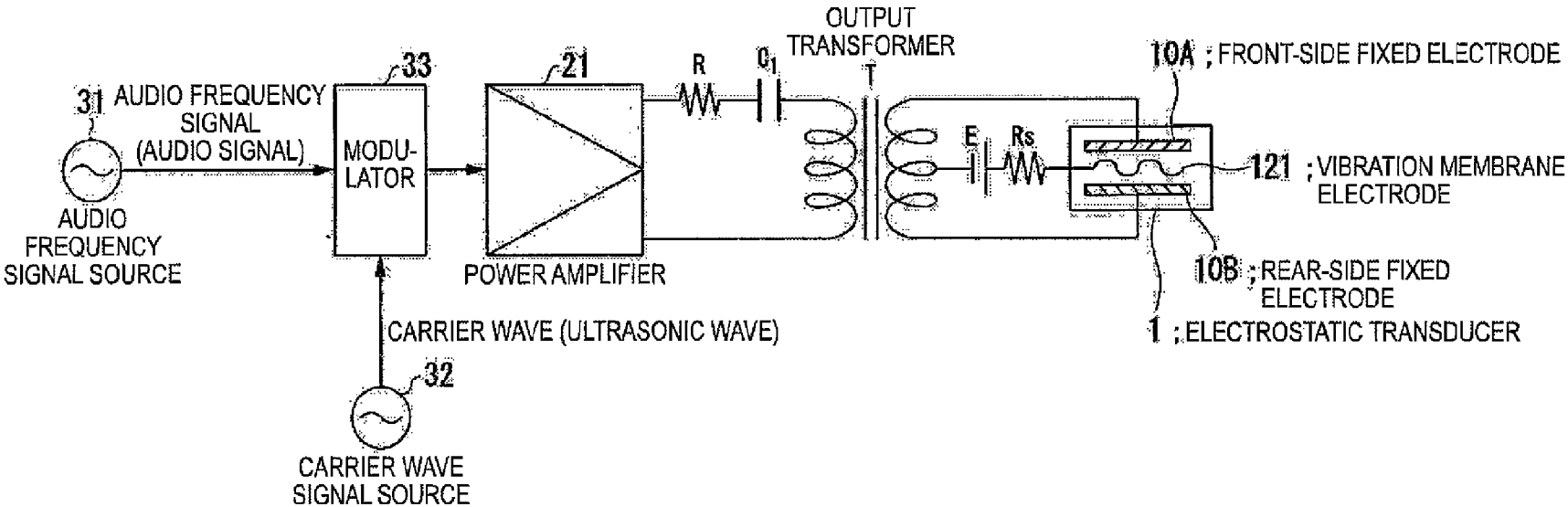
FIG. 12 is a view showing the configuration of an ultrasonic speaker using the driving circuit according to an embodiment of the invention.

FIG. 12 is a view showing the configuration of the ultrasonic speaker using the driving circuit of the electrostatic transducer according to the invention. In the ultrasonic speaker, an original audio signal is self-reproduced in air due to nonlinearity of air by radiating an AM-modulated signal wave obtained by modulating an ultrasonic carrier wave with an audio signal (audible signal) into the air. That is, since a sound wave is a dense wave which is propagated using air as a medium, a dense portion and a nondense portion remarkably occur in air while the modulated ultrasonic wave is propagated. Since an acoustic velocity is high in the dense area and the acoustic velocity is low in the thin area, a distortion occurs in the modulated signal and the distortion accumulates as the modulated ultrasonic wave propagates in the air. The original audio signal (audible frequency component) is included in components of the accumulated distortion. As a result, the original audio signal (audible sound wave) is generated from the modulated signal (ultrasonic wave). Human can hear only the audible sound (original audio signal) less than about 20 kHz. Such a principle is generally called parametric array effect, and the ultrasonic speaker uses the parametric array effect.

The ultrasonic speaker shown in FIG. 12 includes an audio frequency wave signal source (audio signal source) 31 for generating a signal wave in an audio frequency band, a carrier wave signal source 32 for generating and outputting a carrier wave in an ultrasonic frequency band, a modulator 33, and a power amplifier 21, and the others are similar those shown in FIG. 2, which have the same reference numerals.

In the above configuration, the carrier wave in the ultrasonic frequency band output from the carrier wave signal source 32 is modulated with the audio frequency signal (audio signal) output from the audio frequency wave signal source 31 by the modulator 33, and the modulated signal amplified with the power amplifier 21 is applied across the primary side winding of the output transformer T through the resistor R and the coupling capacitance C1. Accordingly, the electrostatic transducer 1 connected to the secondary side winding of the output transformer T is driven.

As a result, the modulated signal is converted into a sound wave of a finite amplitude level by the electrostatic transducer 1, the sound wave is radiated to the medium (air) and a tone in the original audio frequency band is self-reproduced by the nonlinearity of the medium (air). That is, since the sound wave is the longitudinal wave which is propagated using air as the medium, a dense area and a thin area remarkably occur in air while the modulated ultrasonic wave is propagated. Since an acoustic velocity is high in the dense area and the acoustic velocity is low in the thin area, a distortion occurs in the modulated signal and the distortion accumulates as the modulated ultrasonic wave propagates in the air. The original audio signal (audible frequency component) is included in components of the accumulated distortion. As a result, the original audio signal (audible sound wave) is generated from the modulated signal (ultrasonic wave). Human can hear only the audible sound (original audio signal) less than about 20 kHz. Such a principle is generally called parametric array effect, and the ultrasonic speaker uses the parametric array effect.

As described above, in the invention, the circuit constant is set such that the driving frequency (carrier wave frequency) of the electrostatic transducer is matched to the resonance frequency of the parallel resonance circuit formed by the inductance of the output transformer and the load capacitance. Accordingly, the secondary side of the transformer becomes the parallel resonance (antiresonance) state upon rated driving and thus the current flowing into the primary side of the transformer can be reduced while ensuring a predetermined output voltage (load terminal voltage). Accordingly, the power consumption in the driving power amplifier decreases and thus the whole system can be driven with very low loss.

In addition, it is possible to flatten the pass band characteristic of the whole circuit by properly setting the value of the primary side resistor and the primary side coupling capacitance, in conformity to the electrical characteristic (circuit constant) of the output transformer and the load capacitance. That is, since a resonance system having the high pass filter (HPF) and a resonance system having the low pass filter (LPF) are combined by the transformer, the responses of the both resonance systems are matched and flat. Accordingly, it is possible to realize the flat band pass filter (BPF) characteristic in the whole circuit. Therefore, it is possible to stably drive the electrostatic transducer in a wideband. More particularly, when the electrostatic transducer according to the invention is used as the ultrasonic speaker, it is possible to improve reproduction quality due to the flat output characteristic.

The ultrasonic speaker is characterized in that reproduction sound has sharp directivity, but the audible sound can be prevented from being directly output (sound leakage) from the ultrasonic speaker (electrostatic transducer) by setting the circuit constant such that the audio frequency band is not included in the pass band of the circuit. That is, it is possible to suppress directivity deterioration of the reproduction sound due to the sound leakage.

In addition, for example, although the push-pull type electrostatic transducer is described in the above-described embodiment, the load to be driven is not limited to the push-pull type transducer and may be a capacitive load. For example, the circuit design of the invention is applicable to a pull type electrostatic transducer in which a fixed electrode is disposed on one side of the vibration membrane and an attraction acts on only one side of the vibration membrane. In addition, the circuit design of the invention is applicable to an ultrasonic transducer using a piezoelectric element.

Figure 17A:
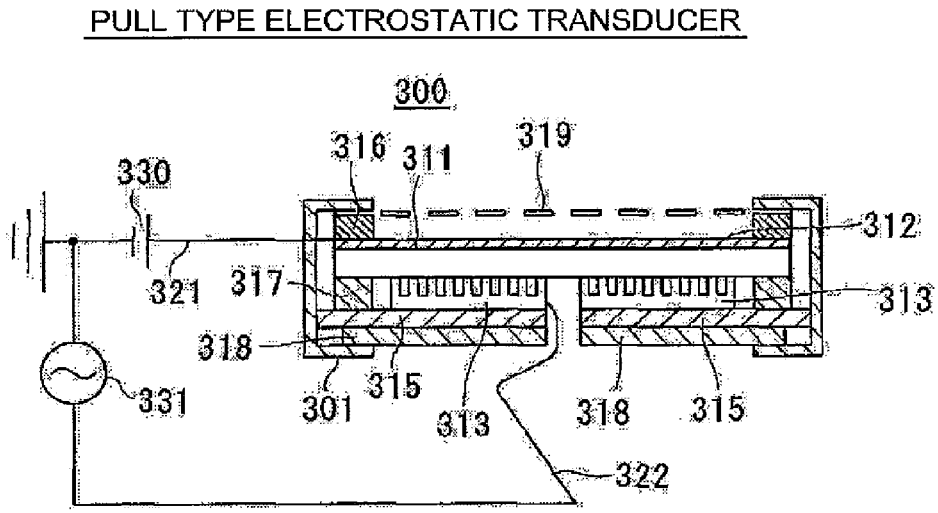
FIGS. 17A and 17B are views showing the circuit configuration of a pull type electrostatic transducer.
Figure 17B:
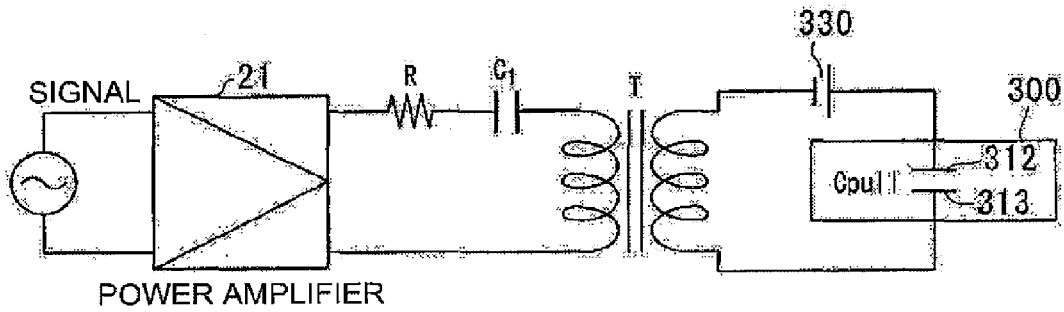

FIGS. 17A and 17B are views showing the circuit configuration of a driving circuit of a pull type electrostatic transducer. The pull type electrostatic transducer 300 shown in FIG. 17A uses a dielectric 311 (insulator) made of polyethylene telephtalate (PET) resin and having a thickness of about 3 to 10 μm as a vibrator (vibration membrane). An upper electrode 312 formed of a metal foil such as aluminum is integrally formed on an upper surface of the dielectric 311 by a process such as deposition. A lower fixed electrode 313 is formed of brass. The lower fixed electrode 313 is placed on a lower surface of the dielectric 311. The lower electrode 313 is connected with a lead 322 and fixed to a base plate 315 made of bakelite or the like.

The upper electrode 312 is further connected with a lead 321 and the lead 321 is connected to a direct current bias power supply 330. A direct current bias voltage having about 50 to 150 V is always applied to the upper electrode 312 by the direct current bias power supply 330 such that the upper electrode 312 is attracted to the lower electrode 313. A reference numeral 331 denotes a signal source.

The dielectric 311, the upper electrode 312 and the base plate 315 are caulked to metal rings 316, 317 and 318 and a mesh 319 by a casing 301.

A plurality of minute grooves (irregularities) of about several tens to several hundreds μm and having random shapes is formed in the surface of the lower electrode 313 at the side of the dielectric 311. Since the minute grooves becomes gaps between the lower electrode 313 and the dielectric 311, the distribution of the capacitance between the upper electrode 312 and the lower electrode 313 minutely varies. The random minute grooves are formed by manually making the surface of the lower electrode 313 with sandpaper. In the pull type electrostatic transducer, the frequency characteristic is broad by forming an infinite number of capacitors having different gap sizes or depths.

The pull type electrostatic transducer shown in FIG. 17A is a capacitive load and the design of the driving circuit of the electrostatic transducer according to the invention is applicable thereto. FIG. 17B is a view showing the circuit configuration of the pull type electrostatic transducer and shows an equivalent capacitance of a piezoelectric ultrasonic transducer 300 by Cpull.

In FIG. 17B, the output from the power amplifier 21 is boosted through the output transformer T and then applied to the pull type transducer Cpull 300. The resistor R and the capacitance C1 are connected in series to the primary side winding of the output transformer T. One terminal of the secondary side winding of the output transformer T is connected to the upper electrode 312 of the pull type electrostatic transducer Cpull 300 through the direct current bias power supply 330 and the other terminal thereof is connected to the lower electrode 313.

By the above configuration, an alternating current signal added to the direct current bias voltage is applied to the upper electrode 312 and the lower electrode 313 of the electrostatic transducer 1. By applying the direct current bias voltage and the alternating current signal to the upper electrode 312, the attraction from the lower electrode 313 to the vibration membrane varies, the vibration membrane 311 vibrates, and a sound wave is radiated from the vibration membrane.

The pull type electrostatic transducer (load capacitance Cpull) is connected to the secondary side of the output transformer T as a driven load, and the circuit constant is set such that the resonance frequency f0 of the circuit formed by the load capacitance Cpull and the self-inductance L2 of the secondary side winding of the output transformer T is matched or approximately matched to the carrier wave frequency (driving frequency) fc of the electrostatic transducer. Accordingly, the secondary side of the transformer T becomes the parallel resonance (antiresonance) upon rated driving and thus the current flowing into the primary side of the transformer T can be reduced while ensuring a desired output voltage (load terminal voltage).

By connecting the resistor R and the capacitor C1 having proper values to the primary side of the output transformer T, it is possible to realize the BPF characteristic (flat output voltage frequency characteristic in the driving frequency band) due to the coupling circuit of the transformer together with the load capacitance Cpull connected to the secondary side of the transformer T.

Figures 18A, 18B:
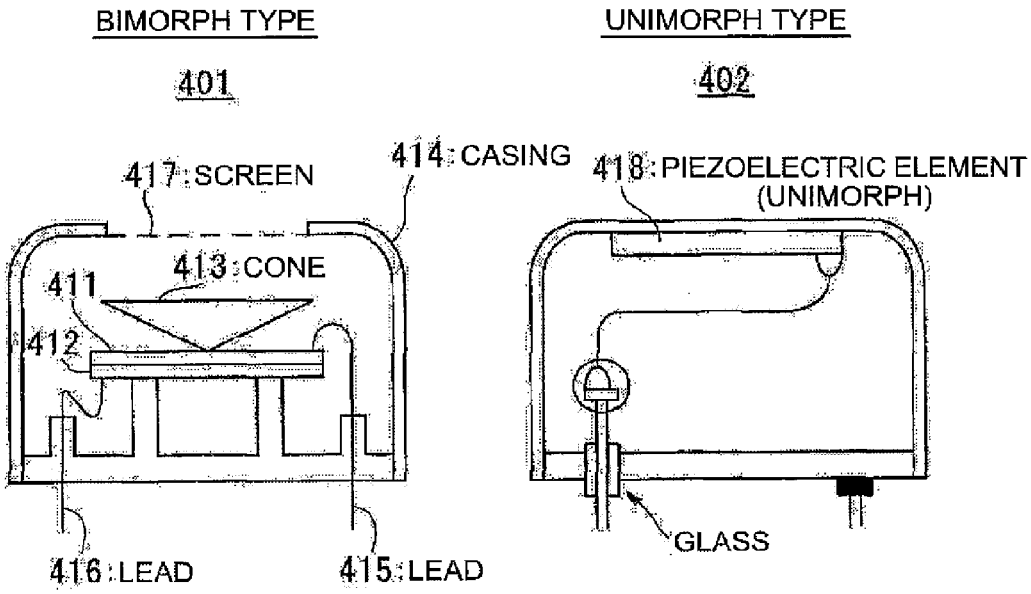
FIGS. 18A to 18C are views showing the circuit configuration of a resonance type ultrasonic transducer.
Figure 18C:
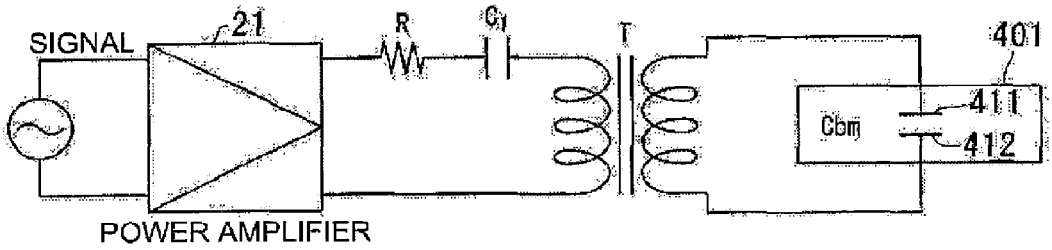

FIGS. 18A to 18C are views showing the configuration of a driving circuit of a piezoelectric ultrasonic transducer and shows the configuration of the piezoelectric ultrasonic transducer which converts an electric signal into an ultrasonic wave using a piezoelectric ceramic as a vibration element. FIG. 18A shows a bimorph type ultrasonic transducer and FIG. 18B shows a unimorph type ultrasonic transducer.

The bimorph type ultrasonic transducer 401 shown in FIG. 18A includes two piezoelectric elements (piezoelectric ceramic) 411 and 412, a cone 413, a casing 414, leads 415 and 416, and a screen 417. The piezoelectric elements 411 and 412 are adhered to each other and surfaces opposite to the adhesion surface of the piezoelectric elements are connected with the lead 415 and the lead 416, respectively. In addition, the unimorph type ultrasonic transducer 402 shown in FIG. 18B basically has the similar operation and principle, except that the configuration of the piezoelectric element 418 is different from that of the bimorph type ultrasonic transducer.

The piezoelectric transducers shown in FIGS. 18A and 18B are capacitive loads and the design of the driving circuit of the electrostatic transducer according to the invention is applicable thereto. FIG. 18C is a view showing the circuit configuration of the piezoelectric ultrasonic transducer and shows an equivalent capacitance of the bimorph type piezoelectric transducer 401 by Cbm.

In FIG. 18C, the output from the power amplifier 21 is boosted through the output transformer T and then applied to the piezoelectric transducer (Cbm) 401. The resistor R and the capacitance C1 are connected in series to the primary side winding of the output transformer T. One terminal of the secondary side winding of the output transformer T is connected to one piezoelectric element 411 of the piezoelectric transducer (Cbm) 401 and the other terminal thereof is connected to the other piezoelectric element 412.

By the above configuration, an alternating current signal is applied to the piezoelectric element 411 and the piezoelectric element 412 of the piezoelectric transducer 401. Accordingly, the piezoelectric elements 411 and 412 vibrate and thus a sound wave is radiated.

The piezoelectric transducer (Cbm) is connected to the secondary side of the output transformer T, and the circuit constant is set such that the resonance frequency f0 of the circuit formed by the load capacitance (Cbm) and the self-inductance L2 of the secondary side winding of the output transformer T is matched or approximately matched to the carrier wave frequency (driving frequency) fc of the piezoelectric transducer. Accordingly, the secondary side of the transformer T becomes the parallel resonance (antiresonance) upon rated driving and thus the current flowing into the primary side of the transformer T can be reduced while ensuring a desired output voltage (load terminal voltage).

By connecting the resistor R and the capacitor C1 having proper values to the primary side of the output transformer T, it is possible to realize the BPF characteristic (flat output voltage frequency characteristic in the driving frequency band) due to the coupling circuit of the transformer together with the load capacitance. Cbm connected to the secondary side of the transformer T.

Description of Display Device Using Ultrasonic Speaker According to the Invention:

Next, an example of a display device using an electrostatic ultrasonic transducer (hereinafter, simply referred to as an "ultrasonic transducer") having the driving circuit according to the invention will be described.

Figure 13:
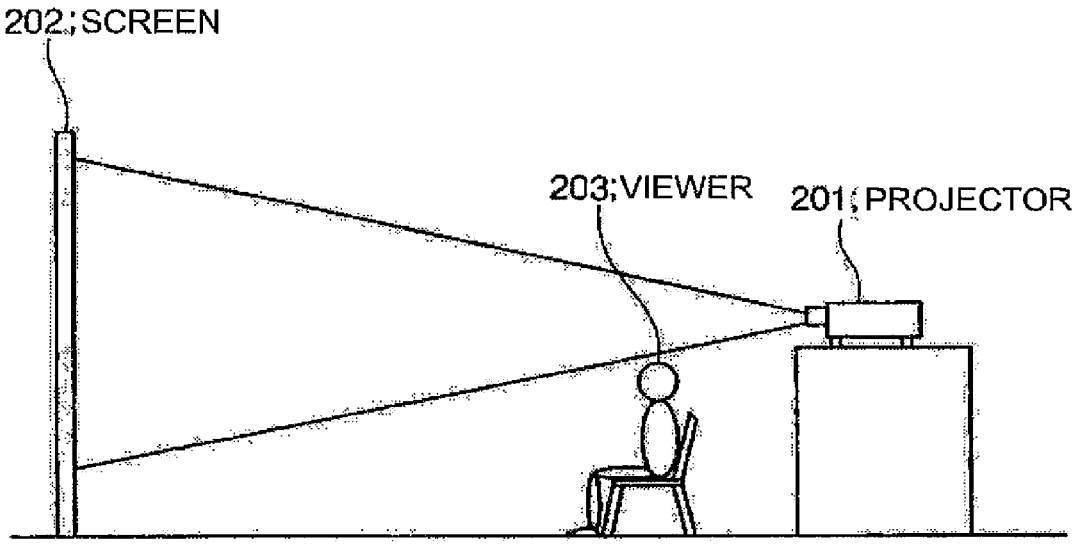
FIG. 13 is a view showing a use state of a projector according to an embodiment of the invention.

FIG. 13 shows a projector as an example of the display device and a use state thereof. As shown in the figure, the projector (display device) 201 is provided on the rear side of a viewer 203, projects an image onto a screen 202 provided on a front side of the viewer 203, and forms a virtual sound source on a projection surface of the screen 202 by the ultrasonic speaker mounted in the projector 201 to reproduce sound.

Figure 14A:
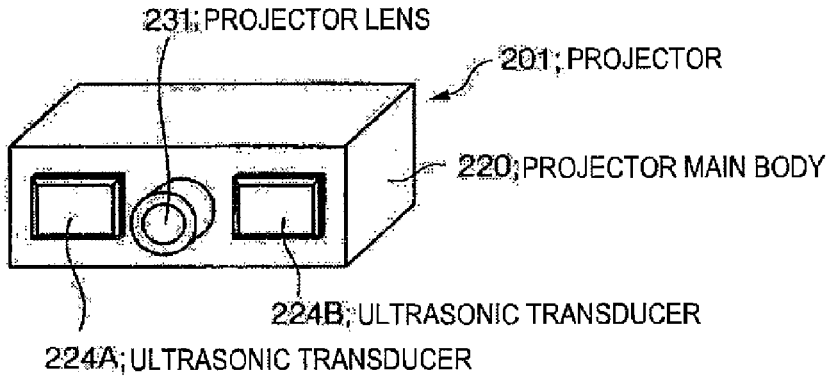
FIGS. 14A and 14B are views showing an appearance configuration of the projector shown in FIG. 13.
Figure 14B:
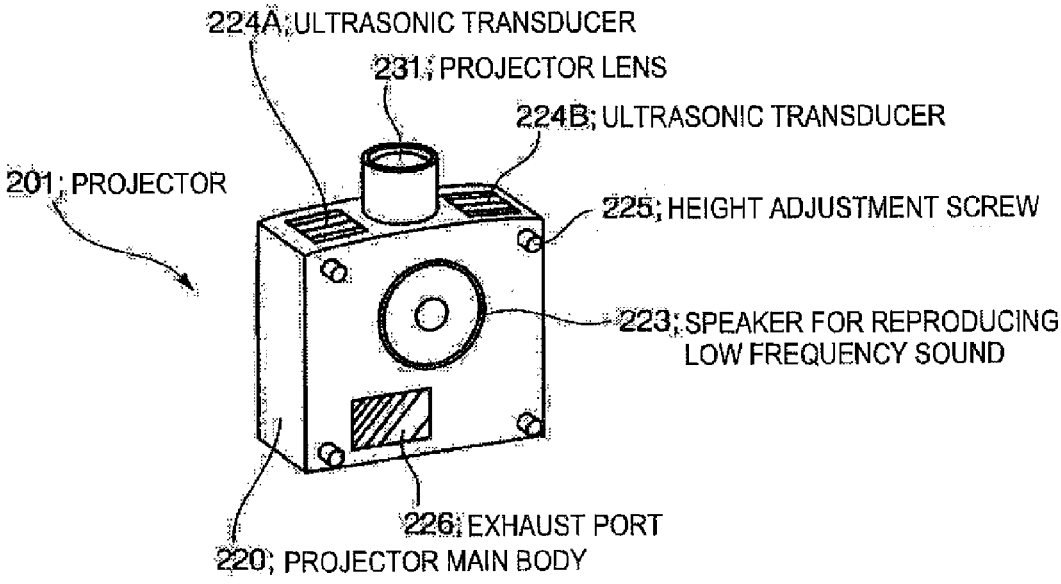

The appearance of the projector 201 is shown in FIGS. 14A and 14B. The projector 201 includes a projector main body 220 including a projection optical system for projecting an image onto a projection surface such as a screen and ultrasonic transducers 224A and 224B which can radiate a sound wave in an ultrasonic frequency band. The ultrasonic speaker for reproducing signal sound in the audio frequency band from an audio signal supplied from an acoustic source is integrally configured. In the present embodiment, in order to reproduce a stereo audio signal, the ultrasonic transducers 224A and 224B for configuring the ultrasonic speaker are horizontally mounted in the projector main body, with a projector lens 231 for configuring the projection optical system interposed therebetween.

In addition, a speaker 223 for reproducing a low frequency sound is provided on the bottom surface of the projector main body 220. A reference numeral 225 denotes a height adjustment screw for adjusting the height of the projector main body 220 and a reference numeral 226 denotes an exhaust port for a cooling fan.

In the projector 201, the electrostatic ultrasonic transducer is used as the ultrasonic transducer for configuring the ultrasonic speaker. The electrostatic ultrasonic transducer has a driving circuit which can be driven with low loss while ensuring a flat output voltage frequency characteristic in a driving frequency band and can radiate an acoustic sound in a broad frequency band (sound wave in the ultrasonic wave frequency band) with a high sound pressure. Accordingly, by changing the frequency of a carrier wave and controlling a spatial reproduction range of a reproduction signal in an audio frequency band, it is possible to realize acoustic effect obtained in a stereo surround system or a 5.1-ch surround system, without requiring a large-scale acoustic system which was used in the related art, and to realize a projector which is easily conveyed.

Figure 15:
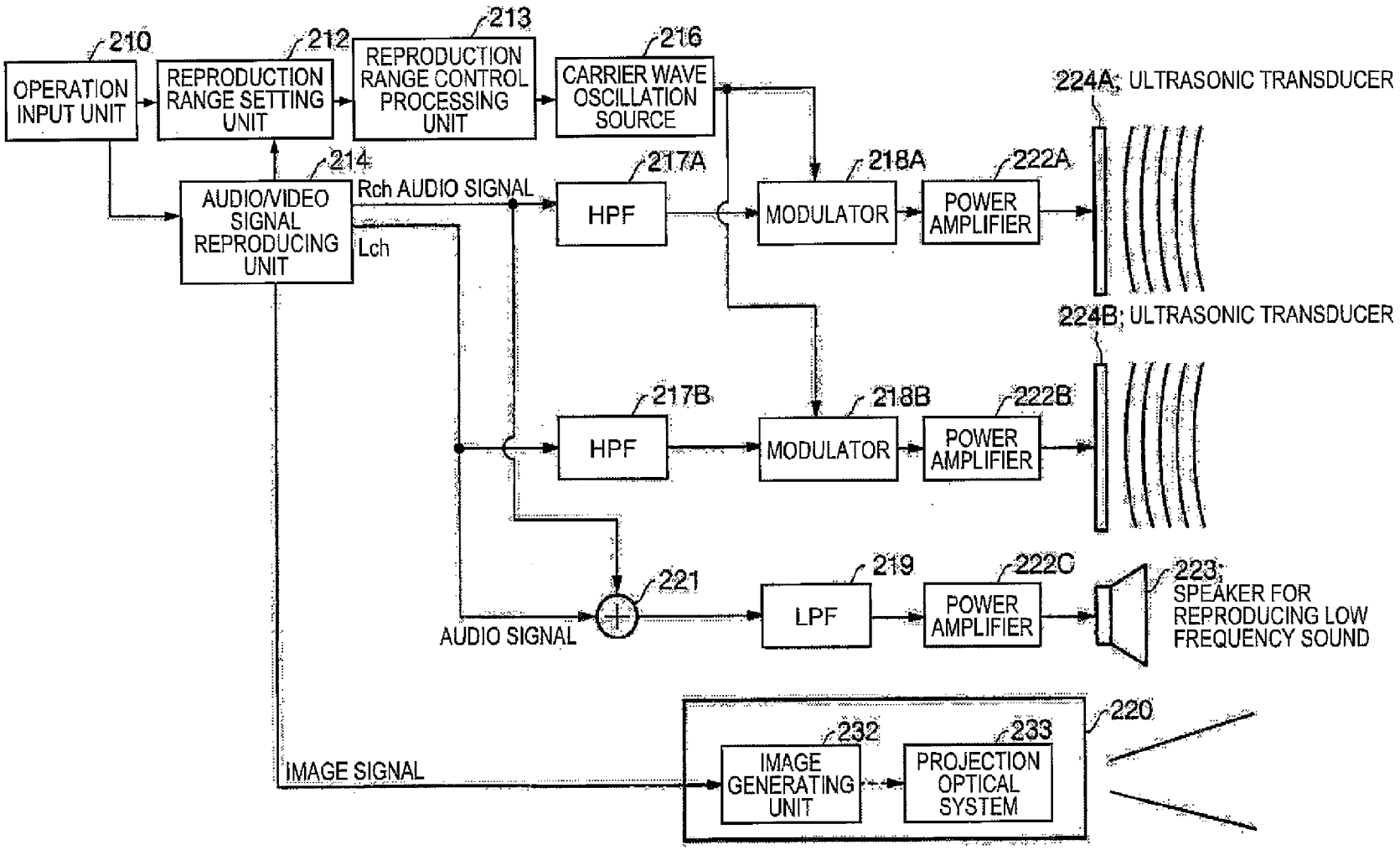
FIG. 15 is a block diagram showing the electrical configuration of the projector shown in FIG. 13.

Next, the electric configuration of the projector 201 is shown in FIG. 15. The projector 201 includes a operation input unit 210, a reproduction range setting unit 212, a reproduction range control processing unit 213, an audio/video signal reproducing unit 214, a carrier wave oscillation source 216, modulators 218A and 218B, the ultrasonic speaker including power amplifiers 222A and 222B and electrostatic ultrasonic transducers 224A and 224B, high pass filters 217A and 217B, a low pass filter 219, a mixer 221, a power amplifier 222C, a speaker 223 for reproducing a low frequency sound, and the projector main body 220. In addition, the electrostatic ultrasonic transducers 224A and 224B are the electrostatic ultrasonic transducer according to the invention.

The projector main body 220 has an image generating unit 232 for generating an image and the projection optical system 233 for projecting the generated image onto the projection surface. In the projector 201, the ultrasonic speaker and the speaker 223 for reproducing the low frequency sound are integrally configured in the projector main body 220.

The operation input unit 210 has a variety of function keys including a numerical keypad, a numbered keyboard, and a power key for turning on/off power. The reproduction range setting unit 212 is used to input data for specifying a reproduction range of a reproduction signal (signal sound) by operating the keys of the operation input unit 210 by a user. When the data is input, the frequency of the carrier wave for defining the reproduction range of the reproduction signal is set, stored and maintained. The setting of the reproduction range of the reproduction signal is performed by specifying a distance in which the reproduction signal reaches from sound wave radiating surfaces of the ultrasonic transducers 224A and 224B in a radiation axis direction.

The reproduction range setting unit 212 sets the frequency of the carrier wave by a control signal output from the audio/video signal reproducing unit 214 according to image contents.

The reproduction range control processing unit 213 has a function for controlling the carrier wave oscillation source 216 such that the frequency of the carrier wave generated by the carrier wave oscillation source 216 is changed to fall into the set reproduction range, by referring to the setting contents of the reproduction range setting unit 212.

For example, when the distance corresponding to the frequency of the carrier wave of 50 kHz is set as internal information of the reproduction range setting unit 212, the carrier wave oscillation source 216 is controlled to oscillate with 50 kHz.

The reproduction range control processing unit 213 has a storage unit for previously storing a table representing a relationship between the distance in which the reproduction signal reaches from the sound wave radiation surface of the ultrasonic transducers 224A and 224B for defining the reproduction range in the radiation axis direction and the frequency of the carrier wave. Data of the table is obtained by actually measuring the relationship between the frequency of the carrier wave and the reaching distance of the reproduction signal.

The reproduction range control processing unit 213 obtains the frequency of the carrier wave corresponding to distance information set by referring to the table, based on the setting contents of the reproduction range setting unit 212, and controls the carrier wave oscillation source 216 to have the frequency.

The audio/video signal reproducing unit 214 is, for example, a DVD player using a DVD as a video medium and the audio signal of an R channel of the reproduced audio signal is output to the modulator 218A through the high pass filter 217A, the audio signal of an L channel is output to the modulator 218B through the high pass filter 217B, and the video signal is output to the image generating unit 232 of the projector main body 220.

The audio signal of the R channel and the audio signal of the L channel output from the audio/video signal reproducing unit 214 is mixed in the mixer 221 and input to the power amplifier 222C through the low pass filter 219. The audio/video signal reproducing unit 214 corresponds to the acoustic source.

The high pass filters 217A and 217B have a property for passing only a frequency component of middle and high frequency range (first range) of the audio signal of the R channel and the L channel and the low pass filter 219 has a property for passing a frequency component of a low frequency range (second range) of the audio signal of the R channel and the L channel.

Accordingly, the audio signal of the middle and high frequency range of the audio signal of the R channel and the L channel is reproduced by the ultrasonic transducer 224A and 224B and the audio signal of the low frequency range of the audio signal of the R channel and the L channel is reproduced by the speaker 223 for reproducing the low frequency sound.

In addition, the audio/video signal reproducing unit 214 is not limited to the DVD player and may be a reproduction device for reproducing a video signal received from the outside. The audio/video signal reproducing unit 214 has a function for outputting the control signal indicating the reproduction range to the reproduction range setting unit 212 such that the reproduction range of reproduction sound is dynamically changed in order to accomplish acoustic effect according to a scene of the reproduced image.

The carrier wave oscillation source 216 has a function for generating and outputting the carrier wave having the frequency in the ultrasonic frequency band instructed from the reproduction range setting unit 212 to the modulators 218A and 218B.

The modulators 218A and 218B have a function for AM-modulating the carrier wave supplied from the carrier wave oscillation source 216 with the audio signal in the audio frequency band output from the audio/video signal reproducing unit 214 and respectively outputting the modulated signals to the power amplifiers 222A and 222B.

The ultrasonic transducers 224A and 224B are driven by modulated signals output from the modulators 218A and 218B through the power amplifiers 222A and 222B and have a function for converting the modulated signals into audio signals having finite amplitude levels, radiating the audio signals to the medium, and reproducing the signal sound (reproduction signal) in the audio frequency band.

The video generating unit 232 has a display such as a liquid crystal display or a plasma display panel (PDP) and a driving circuit for driving the display based on the image signal output from the audio/video signal reproducing unit 214 and generates the image obtained from the image signal output from the audio/video signal reproducing unit 214.

The projection optical system 233 has a function for projecting the image displayed on the display onto the projection surface such as the screen provided on the front side of the projector main body 220.

Next, the operation of the projector 201 having the above configuration will be described. First, the data (distance information) indicating the reproduction range of the reproduction signal from the operation input unit 210 by the key operation of the user is set to the reproduction range setting unit 212 and the audio/video signal reproducing unit 214 receives the reproduction instruction.

As a result, the reproduction range setting unit 212 sets the distance information for defining the reproduction range and the reproduction range control processing unit 213 receives the distance information set by the reproduction range setting unit 212, obtains the frequency of the carrier wave corresponding to the set distance information, by referring to the table stored in the built-in storage unit, and controls the carrier wave oscillation source 216 to generate the carrier wave having the frequency.

As a result, the carrier wave oscillation source 216 generates and outputs the carrier wave having the frequency corresponding to the distance information set by the reproduction range setting unit 212 to the modulators 218A and 218B.

Meanwhile, the audio/video signal reproducing unit 214 outputs the audio signal of the R channel of the reproduced audio signal to the modulator 218A through the high pass filter 217A, outputs the audio signal of the L channel to the modulator 218B through the high pass filter 217B, outputs the audio signal of the R channel and the audio signal of the L channel to the mixer 221, and outputs the image signal to the image generating unit 232 of the projector main body 220.

Accordingly, the audio signal in the middle and high frequency range of the R channel is input to the modulator 218A by the high pass filter 217A and the audio signal in the middle and high frequency range of the L channel is input to the modulator 218B by the high pass filter 217B.

In addition, the audio signal of the R channel and the audio signal of the L channel are mixed by the mixer 221 and the audio signal in the low frequency range of the audio signal of the R channel and the audio signal of the L channel is input to the power amplifier 222C by the low pass filter 219.

The image generating unit 232 generates and displays the image by driving the display, based on the input image signal. The image displayed on the display is projected onto the projection surface, for example, the screen 202 shown in FIG. 13 by the projection optical system 233.

Meanwhile, the modulator 218A AM-modulates the carrier wave output from the carrier wave oscillation source 216 with the audio signal in the middle and high frequency range of the audio signal of the R channel output from the high pass filter 217A and outputs the modulated signal to the power amplifier 222A.

The modulator 218B AM-modulates the carrier wave output from the carrier wave oscillation source 216 with the audio signal in the middle and high frequency range of the audio signal of the L channel output from the high pass filter 217B and outputs the modulated signal to the power amplifier 222B.

The modulated signals amplified by the power amplifiers 222A and 222B are applied between the front-side fixed electrodes (upper electrode) 10A and the rear-side fixed electrodes (lower electrode) 10B (see FIG. 1) of the ultrasonic transducers 224A and 224B and the modulated signals are converted into the sound waves (acoustic signals) having the finite amplitude levels and radiated to the medium (air). The ultrasonic transducer 224A reproduces the audio signal in the middle and high frequency range of the audio signal of the R channel and the ultrasonic transducer 224B reproduces the audio signal in the middle and high frequency range of the audio signal of the L channel.

In addition, the audio signal in the low frequency range of the R channel and the L channel amplified by the power amplifier 222C is reproduced by the speaker 223 for reproducing the low frequency sound.

As described above, in propagation of the ultrasonic wave radiated to the medium (air) by the ultrasonic transducer, the acoustic velocity increases in an area having the high sound pressure and decreases in an area having the lower sound pressure. As a result, a distortion occurs in the waveform.

When the radiated signal in the ultrasonic band (carrier wave) is modulated (AM-modulated) with the signal in the audio frequency band, the signal wave in the audio frequency band used in modulation is separated from the carrier wave in the ultrasonic frequency band to be formed in a self-demodulation form, by the result of the waveform distortion. At this time, the reproduction signal spreads in a beam shape due to the property of the ultrasonic wave and the sound is reproduced only in a specific direction different from that of a general speaker.

The reproduction signal having the beam shape and output from the ultrasonic transducer 224 for configuring the ultrasonic speaker is radiated toward the projection surface (screen) onto which the image is projected by the projection optical system 233 and reflected and spread from the projection surface. In this case, the reproduction range varies depending on the frequency of the carrier wave set by the reproduction range setting unit 212 because a distance from the sound wave radiation surface of the ultrasonic transducer 224 to a place where the reproduction signal is separated from the carrier wave in the radiation axis direction (normal direction) and the beam width (spread angle of the beam) of the carrier wave vary.

Figure 16:
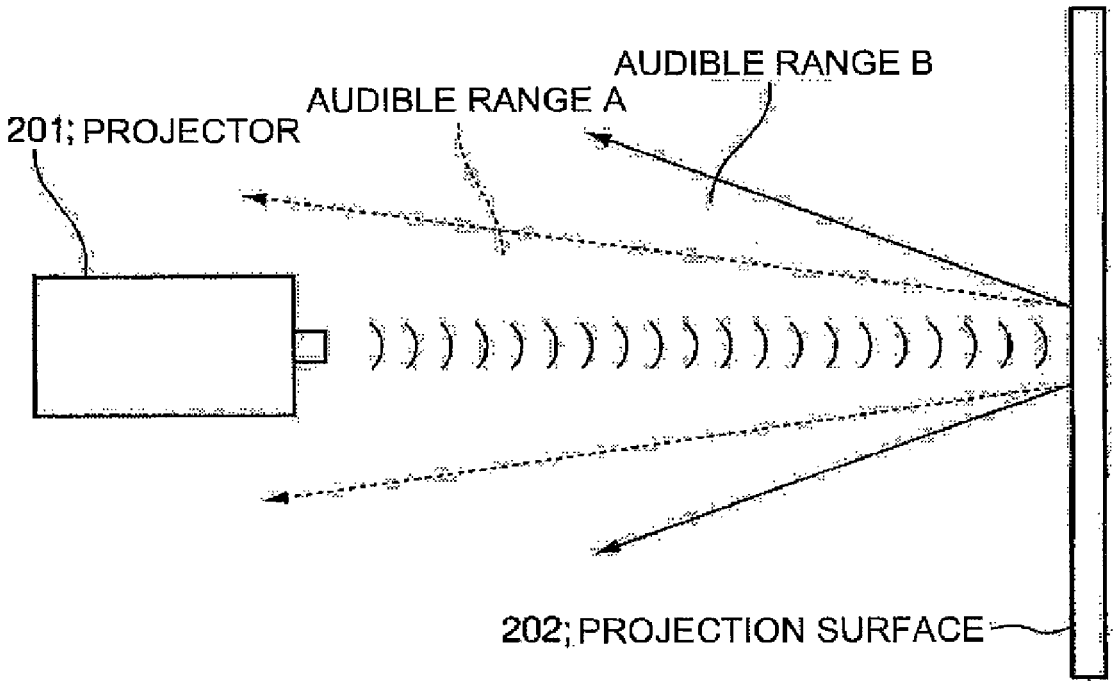
FIG. 16 is a view illustrating a reproduction state of a reproduction signal due to an ultrasonic transducer.

The reproduction state upon reproducing the reproduction signal by the ultrasonic speaker including the ultrasonic transducers 224A and 224B of the projector 201 is shown in FIG. 16. In the projector 201, if the carrier frequency set by the reproduction range setting unit 212 is low when the ultrasonic transducer is driven by the modulated signal obtained by modulating the carrier wave with the audio signal, the distance from the sound wave radiation surface of the ultrasonic transducer 224 to the place where the reproduction signal is separated from the carrier wave in the radiation axis direction (normal direction of the sound wave radiation surface), that is, to the reproduction point, becomes longer.

Accordingly, since the beam of the reproduction signal in the audio frequency band does not relatively spread, reaches the projection surface (screen) 202 and reflects from the projection surface 202 at this state, the reproduction range becomes an audible range A indicated by a dotted arrow of FIG. 16 and the reproduction signal (reproduction sound) is audible only in a range which is relatively narrow and distant from the projection surface 202.

In contrast, when the carrier frequency set by the reproduction range setting unit 212 is higher than that of the above case, the sound wave radiated from the sound wave radiation surface of the ultrasonic transducer 224 is further compressed compared with the case where the carrier frequency is low, but the distance from the sound wave radiation surface of the ultrasonic transducer 224 to the place where the reproduction signal is separated from the carrier wave in the radiation axis direction (normal direction of the sound wave radiation surface), that is, to the reproduction point, becomes shorter.

Accordingly, since the beam of the reproduction signal in the audio frequency band spreads before reaching the projection surface 202, reaches the projection surface 202 and reflects from the projection surface 202 at this state, the reproduction range becomes an audible range B indicated by a solid arrow of FIG. 16 and the reproduction signal (reproduction sound) is audible only in a range which is relatively wide and close to the projection surface 202.

As described above, in the display device (projector or the like) according to the invention, the ultrasonic transducer having the driving circuit according to the invention is used and the ultrasonic transducer can be driven with low loss while ensuring the flat output frequency characteristic. Accordingly, the acoustic signal having a sufficient sound pressure and a wideband characteristic can be reproduced from the virtual sound source provided in the vicinity of a sound wave reflection surface such as the screen. In addition, the reproduction range can be easily controlled.

Although the embodiment of the invention is described, the driving circuit of the electrostatic transducer, the electrostatic ultrasonic transducer, the ultrasonic speaker and the display device according to the invention are not limited to the above embodiment and may be changed without departing from the range of the invention.

The entire disclosure of Japanese Patent Application Nos: 2005-329846, filed Nov. 15, 2005, 2006-200997, filed Jul. 24, 2006 and 2006-246779, filed Sep. 12, 2006 are expressly incorporated by reference herein.

What is claimed is:

1. An ultrasonic speaker comprising:

an electrostatic transducer which is driven by a boosted driving signal by boosting a modulated signal obtained by modulating a carrier wave with an acoustic signal in an audio frequency band and includes an output transformer T which connects the electrostatic transducer to a secondary side winding thereof in parallel and boosts the modulated signal, and a resistor R and a coupling capacitance C1 connected in series to a primary side winding of the output transformer T and in which a circuit constant of a primary side circuit of the output transformer T including a serial circuit of the resistor R and the coupling capacitance C1 and a circuit constant of a secondary side circuit of the output transformer including a self-inductance L2 and a load capacitance CL of the secondary side winding of the output transformer T are set such that a resonance frequency f0 of a circuit formed by the self-inductance L2 of the secondary side winding of the output transformer T and the load capacitance CL(F) of the electrostatic transducer is matched or approximately matched to a carrier wave frequency fc of the electrostatic transducer;

an audio frequency signal source which generates a signal wave in an audio frequency band;

a carrier wave signal source which generates and outputs a carrier wave in an ultrasonic frequency band;

a modulator which modulates the carrier wave with the signal wave in the audio frequency band; and a power amplifier which amplifies the signal modulated by the modulator and applies the amplified signal to the primary side winding of the transformer T through the resistor R and the coupling capacitance C1, wherein, when the load capacitance of the electrostatic transducer is CL(F) and a rated carrier wave frequency of the electrostatic transducer is fc(Hz), the self-inductance L2 of the secondary side winding of the output transformer T is set to $L2=1/(4\pi 2fc2CL)$.

2. An ultrasonic speaker comprising:

an electrostatic transducer which is driven by a boosted driving signal by boosting a modulated signal obtained by modulating a carrier wave with an acoustic signal in an audio frequency band and includes an output transformer T which connects the electrostatic transducer to a secondary side winding thereof in parallel and boosts the modulated signal, and a resistor R and a coupling capacitance C1 connected in series to a primary side winding of the output transformer T and in which a circuit constant of a primary side circuit of the output transformer T including a serial circuit of the resistor R and the coupling capacitance C1 and a circuit constant of a secondary side circuit of the output transformer including a self-inductance L2 and a load capacitance CL of the secondary side winding of the output transformer T are set such that a resonance frequency f0 of a circuit formed by the self-inductance L2 of the secondary side winding of the output transformer T and the load capacitance CL(F) of the electrostatic transducer is matched or approximately matched to a carrier wave frequency fc of the electrostatic transducer;

an audio frequency signal source which generates a signal wave in an audio frequency band;

a carrier wave signal source which generates and outputs a carrier wave in an ultrasonic frequency band;

a modulator which modulates the carrier wave with the signal wave in the audio frequency band; and a power amplifier which amplifies the signal modulated by the modulator and applies the amplified signal to the primary side winding of the transformer T through the resistor R and the coupling capacitance C1, wherein the electrostatic transducer has terminals for applying the driving signal and each of the circuit constants are set such that a frequency characteristic of a voltage between the terminals becomes a frequency characteristic of a band pass filter in which a driving frequency of the electrostatic transducer is included in a pass band.

3. An ultrasonic speaker comprising:

an electrostatic transducer which is driven by a boosted driving signal by boosting a modulated signal obtained by modulating a carrier wave with an acoustic signal in an audio frequency band and includes an output transformer T which connects the electrostatic transducer to a secondary side winding thereof in parallel and boosts the modulated signal, and a resistor R and a coupling capacitance C1 connected in series to a primary side winding of the output transformer T and in which a circuit constant of a primary side circuit of the output transformer T including a serial circuit of the resistor R and the coupling capacitance C1 and a circuit constant of a secondary side circuit of the output transformer including a self-inductance L2 and a load capacitance CL of the secondary side winding of the output transformer T are set such that a resonance frequency f0 of a circuit formed by the self-inductance L2 of the secondary side winding of the output transformer T and the load capacitance CL(F) of the electrostatic transducer is matched or approximately matched to a carrier wave frequency fc of the electrostatic transducer;

an audio frequency signal source which generates a signal wave in an audio frequency band;

a carrier wave signal source which generates and outputs a carrier wave in an ultrasonic frequency band;

a modulator which modulates the carrier wave with the signal wave in the audio frequency band; and a power amplifier which amplifies the signal modulated by the modulator and applies the amplified signal to the primary side winding of the transformer T through the resistor R and the coupling capacitance C1, wherein, in an equivalent circuit of the primary side circuit of the output transformer T of the electrostatic transducer and the secondary side circuit of the output transformer T including a driven load, when a −3 dB attenuation frequency at a lower frequency band side in a frequency characteristic of a first resonance circuit formed by the coupling capacitance C1, a leakage inductance LL of the output transformer T and a mutual inductance M1 is f1L, a −3 dB attenuation frequency at a high frequency band side in a frequency characteristic of a second resonance circuit formed by the coupling capacitance C1, the leakage inductance LL of the output transformer T and the load capacitance CL is f2H, and a resonance frequency of a resonance circuit formed by the mutual inductance M1, the leakage inductance LL and the load capacitance CL is f0, each of the circuit constants are set such that $(f1Lf2H)/f0^2=1$ is satisfied.

4. The ultrasonic speaker according to claim 3, wherein each of the circuit constants of the electrostatic transducer are set such that a combination circuit for combining a first resonance circuit formed by the resistor R, the coupling capacitance C1, the leakage inductance LL and the mutual inductance M1 with a second resonance circuit formed by the resistor R, the coupling capacitance C1, the leakage inductance LL and the load capacitance CL by the output transformer T becomes a critical coupling state.

5. The ultrasonic speaker according to claim 4, wherein, when a quality factor of the first resonance circuit is Q1, a quality factor of the second resonance circuit is Q2, and a coupling coefficient k of the output transformer T is k=(L1−LL)/L1, each of the circuit constants are set such that kQ1 or kQ2 becomes a predetermined value.

6. The ultrasonic speaker according to claim 5, wherein each of the circuit constants are set such that at least one of values √2(kQ1) and √2(kQ2) is equal or approximately equal to 1.

7. The ultrasonic speaker according to claim 3, wherein the each of circuit constants is set such that both the condition of $(f1Lf2H)/f0^2=1$ and the condition that the combination circuit for combining the first resonance circuit formed by the resistor R, the coupling capacitance C1, the leakage inductance LL and the mutual inductance M1 with the second resonance circuit formed by the resistor R, the coupling capacitance C1, the leakage inductance LL and the load capacitance CL by the output transformer T becomes the critical coupling state are satisfied.

8. The ultrasonic speaker according to claim 3, wherein each of the circuit constants are set such that both the condition of $(f1Lf2H)/f0^2=1$ and the condition that, when a quality factor of a first resonance circuit formed by the resistor R, the coupling capacitance C1, the leakage inductance LL and the mutual inductance M1 is Q1, a quality factor of a second resonance circuit formed by the resistor R, the coupling capacitance C1, the leakage inductance LL and the load capacitance CL is Q2, and a coupling coefficient k of the output transformer T is k=(L1−LL)/L1, kQ1 or kQ2 becomes a predetermined value are satisfied.

9. The ultrasonic speaker according to claim 3, wherein each of the circuit constants is set such that both the condition of $(f1Lf2H)/f0^2=1$ and the condition that, when a quality factor of a first resonance circuit formed by the resistor R, the coupling capacitance C1, the leakage inductance LL and the mutual inductance M1 is Q1, a quality factor of a second resonance circuit formed by the resistor R, the coupling capacitance C1, the leakage inductance LL and the load capacitance CL is Q2, and a coupling coefficient k of the output transformer T is k=(L1−LL)/L1, at least one of values √2(kQ1) and √2(kQ2) is equal or approximately equal to 1 are satisfied.

10. The ultrasonic speaker according to claim 3, wherein each of the circuit constants is set such that an audio frequency band is not included in a pass band of a band pass filter formed by the first resonance circuit and the second resonance circuit.

11. The ultrasonic speaker according to claim 3, wherein the electrostatic transducer further includes a first side fixed electrode in which a plurality of holes are formed, a second side fixed electrode in which a plurality of holes are formed, the first side fixed electrode and the second side fixed electrode forming a pair, and a vibration membrane which is interposed between the pair of fixed electrodes and has a conductive layer to which a direct current bias voltage is applied, wherein the secondary side winding of the output transformer T has a center tap, one terminal of the secondary side winding of the output transformer T is connected to the first side fixed electrode of the electrostatic transducer and the other terminal thereof is connected to the second side fixed electrode, and the direct current bias voltage is applied from the center tap of the secondary side winding of the output transformer T to the conductive layer of the vibration membrane.

* * * * *